US008226080B2

(12) United States Patent
Morita et al.

(10) Patent No.: US 8,226,080 B2
(45) Date of Patent: Jul. 24, 2012

(54) SHEET POST-PROCESSING APPARATUS AND IMAGE FORMATION SYSTEM PROVIDED WITH THE APPARATUS

(75) Inventors: Ryo Morita, Toyokawa (JP); Takeharu Takusagawa, Kofu (JP); Toshikazu Tanaka, Yamanashi-ken (JP); Hiroshi Mukoyama, Kofu (JP); Kazuhito Shimura, Kai (JP); Eiji Fukasawa, Yamanashi-ken (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 12/805,074

(22) Filed: Jul. 12, 2010

(65) Prior Publication Data

US 2011/0006476 A1 Jan. 13, 2011

(30) Foreign Application Priority Data

Jul. 10, 2009 (JP) ..... 2009-164187
Jul. 10, 2009 (JP) ..... 2009-164188
Jul. 10, 2009 (JP) ..... 2009-164189
Jul. 10, 2009 (JP) ..... 2009-164190

(51) Int. Cl.
*B65H 39/00* (2006.01)

(52) U.S. Cl. ..... 270/58.13; 270/58.04; 270/58.07; 270/58.12; 270/58.28

(58) Field of Classification Search ..... 270/58.02, 270/58.04, 58.07, 58.08, 58.09, 58.11, 58.12, 270/58.13, 58.27, 58.28
See application file for complete search history.

(56) References Cited

U.S. PATENT DOCUMENTS 7,552,917 B2 * 6/2009 Hayashi et al. ..... 270/58.12
7,694,966 B2 * 4/2010 Nagasako et al. ..... 271/303
2007/0235917 A1 * 10/2007 Nagasako et al. ..... 270/58.08

FOREIGN PATENT DOCUMENTS

JP H01-313261 12/1989
JP 2006-248686 9/2006

* cited by examiner

*Primary Examiner* — Leslie A Nicholson, III
(74) *Attorney, Agent, or Firm* — Manabu Kanesaka

(57) ABSTRACT

To provide a sheet post-processing apparatus enabling a sheet to be aligned in a predetermined collection position irrespective of the basis weight of the sheet and image formation surface in dropping and collecting the sheet onto a tray from a sheet discharge outlet, the apparatus has a tray for collecting a sheet from the sheet discharge outlet, and a sheet discharge rotating body for transferring the sheet that is carried out to the tray toward a sheet end regulation member, and is configured to be able to adjust the timing of shifting the sheet discharge rotating body to an operation position engaging in the sheet from a withdrawal position above the tray corresponding to image formation conditions of the sheet.

20 Claims, 19 Drawing Sheets

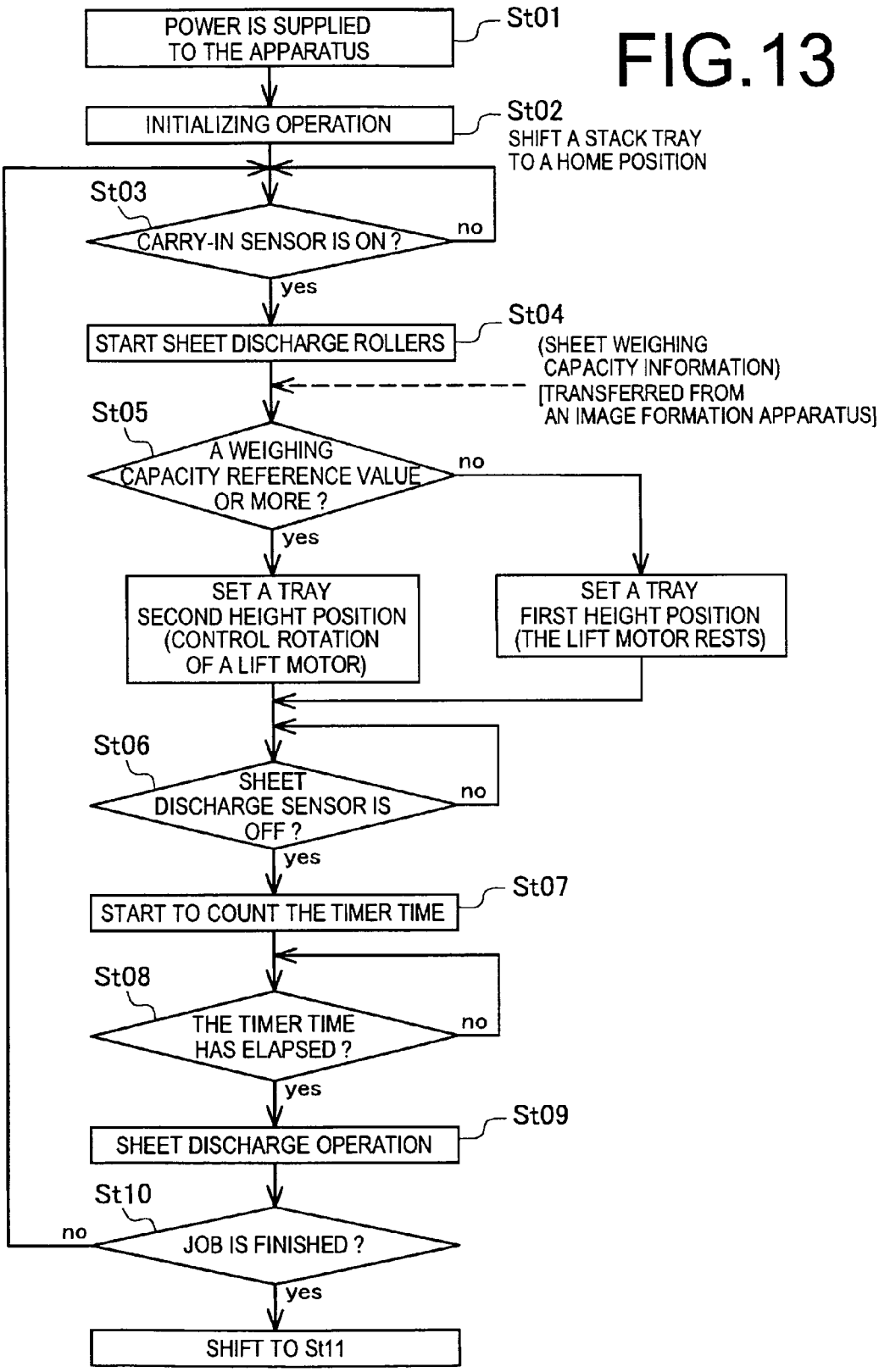
FIG.13
POWER IS SUPPLIED TO THE APPARATUS
St01
INITIALIZING OPERATION
St02
SHIFT A STACK TRAY TO A HOME POSITION
St03
CARRY-IN SENSOR IS ON ?
no
yes
START SHEET DISCHARGE ROLLERS
St04
(SHEET WEIGHING CAPACITY INFORMATION)
[TRANSFERRED FROM AN IMAGE FORMATION APPARATUS]
St05
A WEIGHING CAPACITY REFERENCE VALUE OR MORE ?
no
yes
SET A TRAY SECOND HEIGHT POSITION (CONTROL ROTATION OF A LIFT MOTOR)
SET A TRAY FIRST HEIGHT POSITION (THE LIFT MOTOR RESTS)
St06
SHEET DISCHARGE SENSOR IS OFF ?
no
yes
START TO COUNT THE TIMER TIME
St07
St08
THE TIMER TIME HAS ELAPSED ?
no
yes
SHEET DISCHARGE OPERATION
St09
St10
JOB IS FINISHED ?
no
yes
SHIFT TO St11

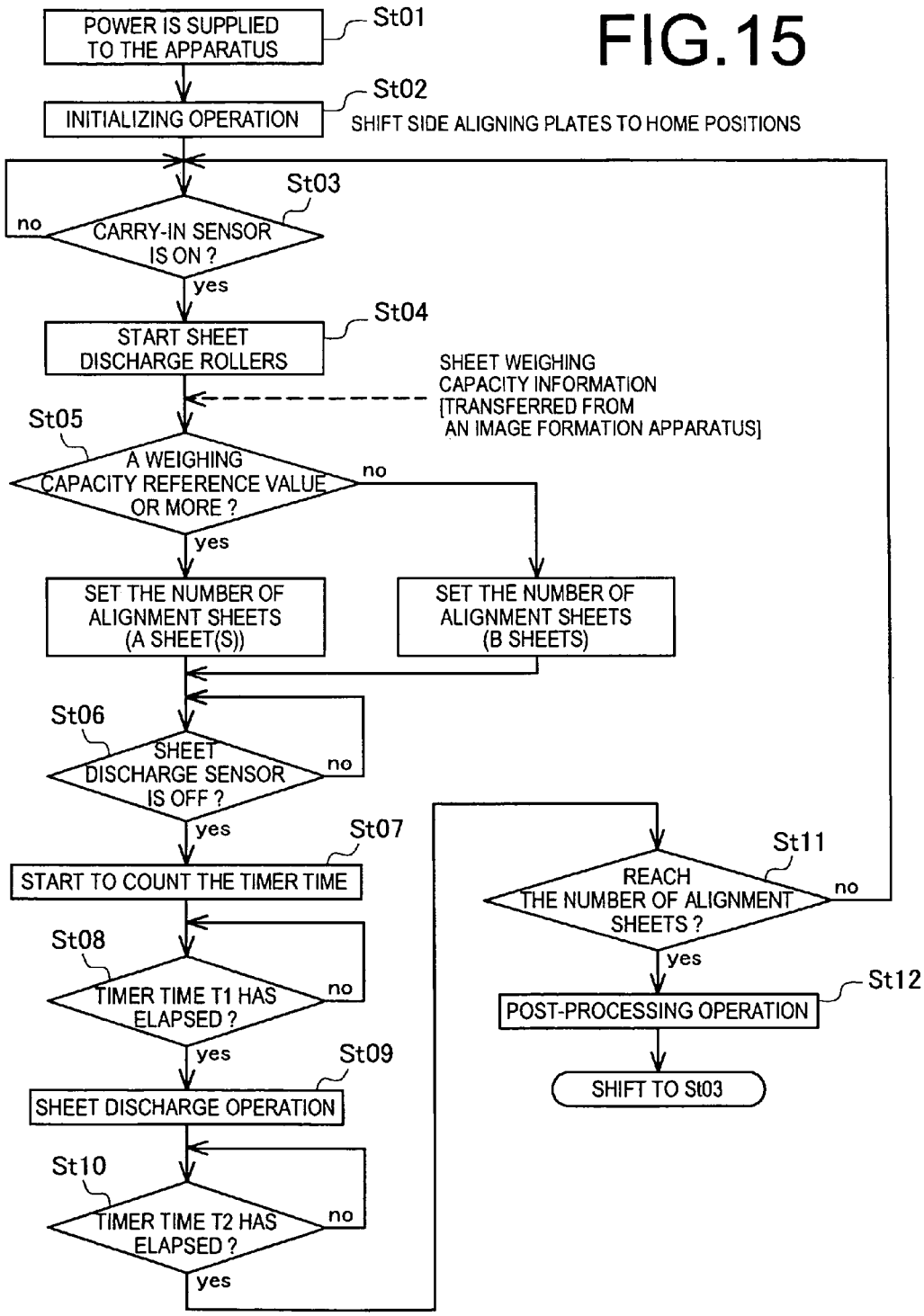
FIG.15
POWER IS SUPPLIED TO THE APPARATUS
St01
INITIALIZING OPERATION
St02
SHIFT SIDE ALIGNING PLATES TO HOME POSITIONS
St03
CARRY-IN SENSOR IS ON ?
no
yes
START SHEET DISCHARGE ROLLERS
St04
SHEET WEIGHING CAPACITY INFORMATION [TRANSFERRED FROM AN IMAGE FORMATION APPARATUS]
St05
A WEIGHING CAPACITY REFERENCE VALUE OR MORE ?
no
yes
SET THE NUMBER OF ALIGNMENT SHEETS (A SHEET(S))
SET THE NUMBER OF ALIGNMENT SHEETS (B SHEETS)
St06
SHEET DISCHARGE SENSOR IS OFF ?
no
yes
St07
START TO COUNT THE TIMER TIME
St08
TIMER TIME T1 HAS ELAPSED ?
no
yes
St09
SHEET DISCHARGE OPERATION
St10
TIMER TIME T2 HAS ELAPSED ?
no
yes
St11
REACH THE NUMBER OF ALIGNMENT SHEETS ?
no
yes
St12
POST-PROCESSING OPERATION
SHIFT TO St03

SHEET POST-PROCESSING APPARATUS AND IMAGE FORMATION SYSTEM PROVIDED WITH THE APPARATUS

BACKGROUND OF THE INVENTION

The present invention relates to a sheet post-processing apparatus for performing post-processing such as stitching on sheets carried out of an image formation apparatus such as a copier and printer, and more particularly, to improvements in a sheet alignment mechanism for aligning a sheet carried out onto a tray in a predetermined position.

BACKGROUND ART

Generally, this type of sheet post-processing apparatus is widely known as an apparatus in which a processing tray is provided in a sheet discharge outlet of an image formation apparatus such as a copier and printer, is provided with a post-processing apparatus such as a stapler apparatus, punch apparatus and stamp apparatus, and collates and collects sheets fed from the image formation apparatus to perform post-processing.

Conventionally, in such an apparatus, an apparatus configuration has been known in which a processing tray is disposed on the downstream side of a sheet discharge outlet, a stack tray is disposed on the downstream side of the processing tray, and sheets (bunch) subjected to post-processing in the processing tray are stored on the stack tray. For example, Patent Document 1 discloses a structure where a height difference is formed on the downstream side of the sheet discharge outlet to provide the processing tray, the stack tray is arranged in the substantially same plane on the downstream side of the processing tray, and a sheet from the sheet discharge outlet is supported (bridge-supported) at the sheet front end portion on the stack tray, while being supported at the sheet rear end portion on the processing tray.

In such an apparatus, the need of providing a sheet alignment mechanism in the processing tray arises to align a sheet carried out of the sheet discharge outlet in a predetermined regulation stopper position with the sheet bridge-supported between two trays, and it is necessary to align the sheet correctly in a predetermined load position on the processing tray irrespective of various conditions such as the basis weight (mass) of the sheet and image formation surface (one-side/two-side) in collecting the sheet with an image formed on the tray from the sheet discharge outlet. Therefore, in Patent Document 1, a roller capable of moving up and down is provided above the processing tray, and is lowered to an operation position coming into contact with a sheet from an upper withdrawal position after the sheet front end reaches the stack tray from the sheet discharge outlet. Then, the roller is rotated in the opposite direction to the sheet discharge direction, and the sheet rear end carried out of the sheet discharge outlet is struck against a regulation stopper and is aligned.

Conventionally, in the case of carrying out a sheet onto the tray having a height difference from the sheet discharge outlet, a sheet discharge rotating body such as a roller and belt is provided above the tray to be able to move up and down, and is moved to the operation position engaging in the sheet from the withdrawal position at timing at which the sheet rear end is passed through the sheet discharge outlet, and by transport force of the rotating body, the sheet strikes the regulation stopper. In this case, the sheet discharge rotating body is lowered to the operation position at the predicted time the sheet rear end is passed through the sheet discharge outlet and carried out onto the tray with reference to a signal from a sheet detection sensor.

Patent Document 2 discloses a similar apparatus for controlling a stack tray which is configured to be able to move up and down to move into the same plane as that of a processing tray in positioning and collecting a sheet in a regulation position (stopper position) of the processing tray. In other words, in collating and collecting a sheet from the sheet discharge outlet on the processing tray, the stack tray is moved up and down so that the both trays are positions in the substantially same plane.

PRIOR ART DOCUMENTS

[Patent Document 1] Japanese Unexamined Patent Publication No. 2006-248686

[Patent Document 2] Japanese Examined Patent Publication No. H08-9451

In Patent Document 1, in striking a sheet carried out of the sheet discharge outlet against the regulation stopper on the tray to align, the sheet discharge rotating body capable of moving up and down is provided on the tray forward of the sheet discharge outlet, and is lowered to the position engaging in the sheet at timing at which the sheet rear end is passed through the sheet discharge outlet. Then, by rotation of this rotating body, the sheet is struck against the regulation stopper on the tray and aligned. Conventionally, the timing at which this sheet discharge rotating body is lowered to the operation position from the withdrawal position has been set constant irrespective of the sheet transport state.

However, recent image formation apparatuses have been forced to use sheets with extremely wide properties (sheet thickness, basis weight), and concurrently, image formation conditions have become wide such as two-sided printing, one-sided printing, monochrome printing and color printing.

For example, in image formation of photograph data, coating sheets are used, and the surface frictional force when the sheet undergoes two-sided printing is remarkably low as compared with the case of performing one-sided printing on normal sheets. Further, there is a case of using extremely thick paper, for example, with 200 to 300 grams in forming an image on a front cover for bookbinding. Meanwhile, extremely thin paper sheets are used in forming images on Japanese paper of the like, and with progression of multi-function in the image formation apparatus, properties of sheets to use become wide. In this case, the following problem occurs in setting the timing of lowering the sheet discharge rotating body onto the tray at constant timing.

FIG. 11 shows defects due to conventional sheet discharge timing. In a sheet S carried out on a processing tray 101 and stack tray 102 from a sheet discharge outlet 100 by a sheet discharge roller 104, the front end St is transported to the processing tray from the sheet discharge outlet, and then, to the stack tray sequentially. Then, after the sheet front end St reaches a forward/backward rotation roller (sheet discharge rotating body) 103, the roller is lowered from the upper withdrawal position, and is rotated in the operation position engaging in the sheet in the opposite direction to the sheet discharge direction (the arrow direction in FIG. 11).

By this operation, the sheet rear end Se is struck against a regulation stopper 105 provided in a post-processing position of the processing tray 101 and regulated. Then, the timing at which the forward/backward rotation roller 103 is lowered to the operation position from the withdrawal position is to move to the operation position after a lapse of predicted time the sheet rear end Se is passed through the sheet discharge outlet 100, for example, by detecting the sheet rear end Se by a sensor 106 provided on the upstream side of the sheet discharge outlet 100.

In such a configuration, when the forward/backward rotation roller 103 strikes the sheet rear end Se against the regulation stopper 105 to stop, cases occur frequently that the sheet rear end Se does not arrive at the regulation position, and that the sheet rear end Se overruns beyond the regulation position (resulting in a phenomenon that the sheet rises or the front end is folded). Particularly, when the allowable scope of sheets is wide of from thick paper to thin paper, or in the case of performing image formation by one-sided monochrome printing and two-sided color printing, large fluctuations occur in position regulation of the sheet rear end.

Therefore, experiments were made by setting the circumferential velocity of the sheet discharge roller 104 and the drop difference (height difference) between the sheet discharge outlet 100 and processing tray 101 at the same conditions, while varying the image formation conditions such as the basis weight (mass) of the sheet and printing mode. As a result, it was found out that the sheet rear end lands farther in one-sided monochrome printing as compared with two-sided color printing, and that the sheet rear end lands farther when the basis weight (mass) of the sheet is large as compared with the basis weight is small.

As a result of the experiments, as shown in FIG. 11(*a*), it was found out that the sheet rear end lands at a long distance (L1 shown in the figure) on the tray from the sheet discharge outlet in the case that "printing is made on one side of the sheet (the coefficient of surface friction is lower than the case of two-sided printing)" and that "the basis weight (mass) of the sheet is large". Meanwhile, as shown in FIG. 11(*b*), it was found out that the sheet rear end lands at a short distance (L2 shown in the figure) on the tray from the sheet discharge outlet in the case that "printing is made on two sides of the sheet" and that "the basis weight (mass) of the sheet is small".

It is considered that such a difference (L1>L2) in the landing distance between sheets dropping onto the tray from the sheet discharge outlet is caused by a difference in inertia force between sheets in the sheet discharge outlet, and is caused by the fact that the inertia force of the sheet is large in the case of high-nerve thick sheets and one-sided printing where the coefficient of friction of the sheet surface is large, while the inertia force of the sheet is small in the case of low-nerve thin sheets and two-sided printing.

Therefore, the inventor of the invention arrived at the technical idea of varying the operation timing of lowering the forward/backward rotation roller to the operation position corresponding to the material of a sheet to form an image and image formation conditions such as an image formation surface, and thereby aligning the sheet correctly in a predetermined collection position on the processing tray. Further, in Patent Document 2, the height position of the stack tray is set at a certain height position irrespective of properties of sheets, and this position is set at a position in the substantially same plane as that of the processing tray or at a position such that the stack tray side is slightly lower, in feeding the sheet to a post-processing position (at the time of switch-back transport). However, in aligning an extremely thick sheet on the processing tray from the sheet discharge outlet 100, when the stack tray side is set to be lower, since the thick sheet has the high nerve, the sheet rear end side does not drop onto the tray, and remains in the sheet discharge outlet, and a jam thereby arises. Then, when the stack tray is set in a high position, the sheet rear end side, which is the opposite side to the stack tray existing in a high position, moves downward due to the high nerve of the sheet itself, and is prevented from remaining in the sheet discharge outlet. However, when a sheet to discharge is a thin sheet and the height position of the stack tray is set to be high, since the sheet has the low nerve, the sheet is curved, and the transport force for feeding the sheet front end in the sheet discharge direction is reduced. Thus, when the stack tray is set in a high position, obtained is the result that the rear end remaining phenomenon frequently occurs such that the rear end of the low-nerve thin sheet remains in the sheet discharge outlet.

Then, the inventor of the invention reached the technical idea of adjusting the height position of the stack tray that supports the sheet front end portion corresponding to the basis weight (mass) of a sheet in collating and collecting the sheet in the post-processing position of the processing tray from the sheet discharge outlet, and thereby aligning the sheet correctly in a predetermined collection position on the processing tray.

It is a main object of the invention to provide a sheet post-processing apparatus for enabling a sheet to be aligned correctly in a predetermined collection position irrespective of the basis weight (mass) of the sheet and image formation surface (one-side/two-side) in dropping and collecting the sheet with the image formed onto the tray from the sheet discharge outlet. Further, it is another object of the invention to construct a compact and small-size processing tray for collating and collecting sheets in a post-processing apparatus with a post-processing unit built inside the apparatus.

It is still another object of the invention to provide a sheet post-processing apparatus capable of reliably transporting a sheet to a regulation position on the processing tray by setting the sheet discharge direction of the sheet from the sheet discharge outlet to be optimal based on the basis weight information such as a thickness and weight of the sheet, and reducing paper jams in transporting the sheet.

BRIEF SUMMARY OF THE INVENTION

In addition, in the invention, "image formation conditions" are conditions of a sheet surface to form an image such as the basis weight (mass per unit area) of a sheet to form an image, one-side/two-side, and monochrome/color image. To attain the above-mentioned objects, the invention provides a tray means for collecting a sheet from a sheet discharge outlet, and a sheet discharge rotating body for transferring the sheet that is carried out to the tray means toward a sheet end regulation means, and is characterized in that the timing of shifting the sheet discharge rotating body to an operation position engaging in the sheet from a withdrawal position above the tray is configured to be adjustable corresponding to image formation conditions of the sheet.

The configuration will be described specifically. Provided are a sheet discharge outlet (24), a tray means (processing tray 28 described later) for loading and collecting a sheet fed from the sheet discharge outlet, a sheet end regulation means (rear end regulation stopper 30 described later) that is provided on the tray means to regulate an and edge of the sheet, a sheet discharge rotating body (forward/backward rotation roller 35 described later) for transferring the sheet that is carried out onto the tray means toward the sheet end regulation means, a lifting/lowering support means (bracket 34 described later) for supporting the sheet discharge rotating body to be able move up and down between an operation position (Fp) coming into contact with the sheet on the tray means and a withdrawal position (Wp) separated from the sheet, a lifting/lowering driving means (lifting/lowering motor MS described later) for driving the lifting/lowering support means, and a lifting/lowering control means (control CPU 65 described later) for controlling the lifting/lowering driving means.

Then, the lifting/lowering control means is configured to be able to adjust the operation timing of shifting the sheet discharge rotating body to the operation position from the withdrawal position corresponding to image formation conditions of the sheet after the sheet rear end is passed through the sheet discharge outlet. In addition, the above-mentioned tray means is provided with a post-processing means (37) for performing post-processing on collected sheets, and a stack tray (29) for storing the post-processed sheets. Then, the sheet discharge outlet is provided with a sheet sensor (sheet discharge sensor S2 described later) for detecting front and rear ends of the sheet to be carried out sequentially, and with reference to a signal that the sensor detects the sheet rear end, it is configured that the sheet discharge rotating body is shifted to the operation position from the withdrawal position.

The present invention provides the tray means for collecting a sheet from the sheet discharge outlet, and the sheet discharge rotating body for transferring the sheet that is carried out to the tray means toward the sheet end regulation means, where the timing of shifting the sheet discharge rotating body to the operation position engaging in the sheet from the withdrawal position above the tray is configured to be adjustable corresponding to the image formation conditions of the sheet, and therefore, produces the following effects.

A sheet carried out of the sheet discharge outlet is struck against the sheet end regulation means by the sheet discharge rotating body and is aligned after the rear end of the sheet is passed through the sheet discharge outlet. At this point, the landing position on the tray is displaced forward or backward in the sheet discharge direction corresponding to the mass (basis weight) of the sheet and printed area (one-side or two-side). At this point, when the sheet transfer amount (distance) of the sheet discharge rotating body is the same, the sheet end does not arrive at the regulation position or the front end bending caused by overrun occurs. In contrast thereto, in the invention, the timing at which the sheet discharge rotating body transfers the sheet toward the regulation stopper is advanced or delayed corresponding to the above-mentioned position displacement amount, and it is thereby possible to always align the sheet in a correct position.

Further, the configuration for the foregoing can be made compact by a simplified structure by advancing the operation start timing of the sheet discharge rotating body when the image formation surface of the sheet to carry out of the sheet discharge outlet is one side, while delaying the operation start timing in two-sided printing. Similarly, by advancing the timing when the mass (basis weight) of the sheet to carry out of the sheet discharge outlet is a predetermined value or more, while delaying the timing when the mass is less than the predetermined value, it is possible to construct the compact configuration with the simplified structure.

Thus, in the invention, even when the landing position that the sheet is dropped onto the tray means is different corresponding to the image formation conditions, by varying the start timing of the sheet alignment operation of the sheet discharge rotating body, it is possible to cause the sheet rear end to reliably arrive at the regulation stopper.

BRIEF DESCRIPTION OF THE SEVERAL VIEWS OF THE DRAWINGS

FIG. 13 is a flowchart illustrating the operation state in the control configuration in FIG. 9;

FIG. 15 is another flowchart illustrating the operation state in the control configuration in FIG. 9;

DETAILED DESCRIPTION OF PREFERRED EMBODIMENTS

Image Formation System

Figure 1:
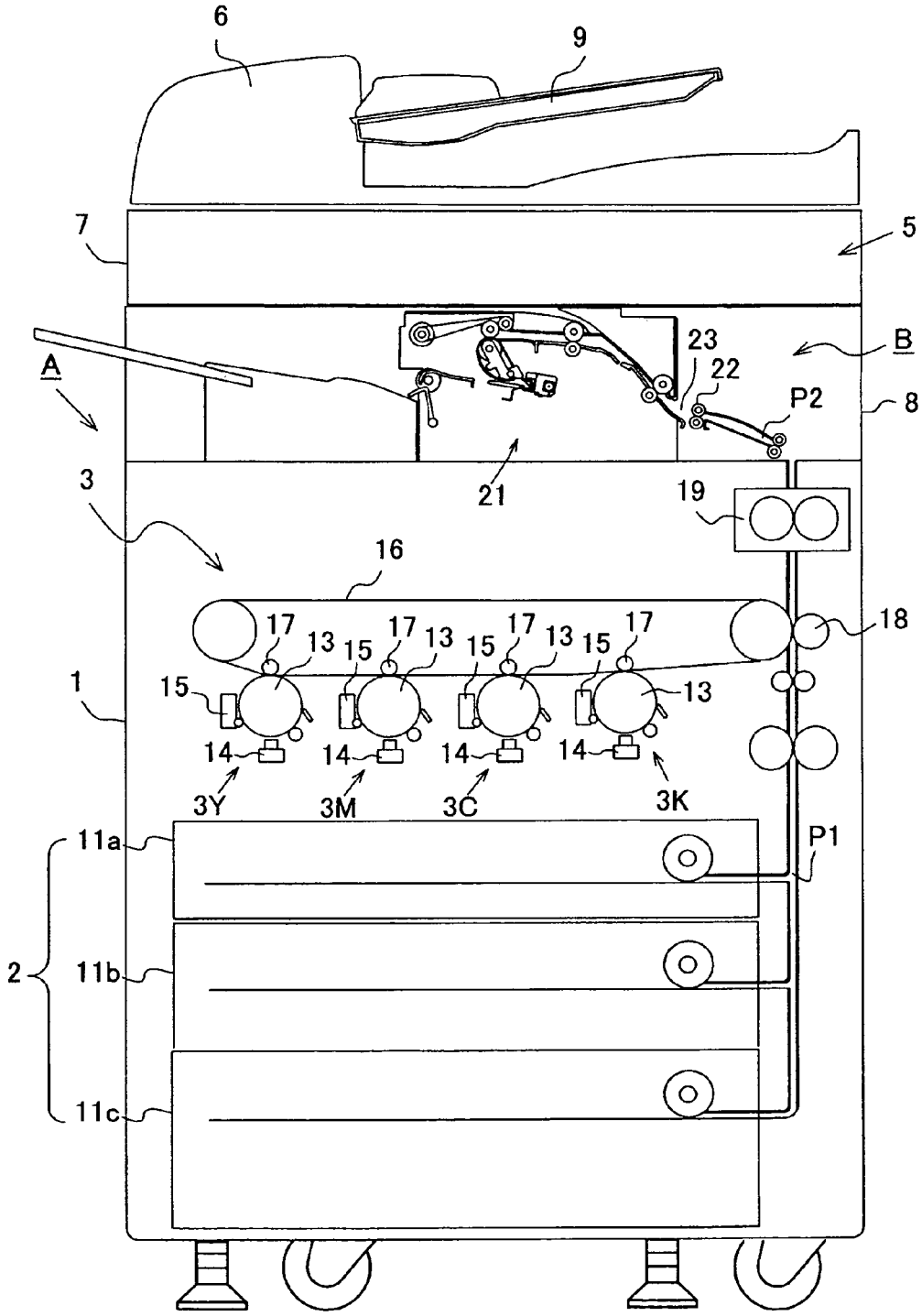
FIG. 1 is an explanatory view of an entire configuration of an image formation apparatus formation system according to the invention.

An image formation system as shown in FIG. 1 is comprised of an image formation apparatus A and sheet post-processing apparatus B, and the image formation apparatus A is configured to form an image on a sheet based on designated image data, and carry out the sheet to a sheet discharge outlet. The sheet post-processing apparatus B is configured to receive the sheet with the image formed from the sheet discharge outlet, align the sheet in a predetermined post-processing position to perform post-processing, and then, store the processed sheets (bunch) in a stack tray. Each configuration will specifically be described below.

[Configuration of the Image Formation Apparatus]

The image formation apparatus A is provided with a paper feed section 2, image formation section 3 and image data storing section inside a casing 1. The paper feed section 2 is comprised of, for example, a plurality of paper cassettes 11*a*, 11*b*, 11*c*, and each of the cassettes 11*a*, 11*b*, 11*c* stores sheets of a beforehand selected standard size. Further, the paper feed section 2 is provided with a manual feed tray (not shown in the figure), and is configured so that a user is capable of inserting sheets corresponding to the use object. With respect to the sheets set in the paper feed section 2 with such a configuration, it is configured that information of sheet conditions such as the size, material (coating sheet or normal sheet) and paper thickness (thick sheet or thin sheet) is input from a control panel 63 described later.

The image formation section 3 is configured to form an image on a sheet fed from the paper feed section 2, and the section 3 shown in the figure indicates an electrostatic image formation mechanism. The image formation section 3 is provided with four image formation units 3Y (yellow), 3M (magenta), 3C (cyan) and 3K (black) each comprised of a photosensitive drum 13, printing head (emitter of laser light, LED light, etc.) 14 for forming a latent image on the drum surface, and a development device 15. Image ink (toner) formed on the photosensitive drum of each of the units 3Y to 3K is transferred to a transfer belt 16 by a transfer charger 17.

Then, an electrostatic latent image is formed on the photosensitive drum 13 by the printing head 14, the toner is adhered by the development device 15, and the image is transferred onto the transfer belt 16 by the transfer charger 17. In the case of a color image, the image transfer is performed by superimposing color data of YMCK, and a final image is formed on the transfer belt 16. Then, the image is transferred onto the sheet fed to a paper feed path P from the paper feed section 2. "18" shown in the figure denotes a charger for transferring the image onto the sheet.

The sheet with the image thus transferred is carried out to a sheet discharge path P2 via a fusing device 19. Moreover, the image formation section 3 is not limited to the electrostatic image formation mechanism as shown in the figure, and as the section 3, it is possible to adopt various image formation mechanisms such as an inkjet type image formation mechanism and offset type image formation mechanism.

The image data storing section is not shown in the figure, but is comprised of image memory of image data to form on the photosensitive drum 13 by the printing head 14 of the image formation section 3, and the data is transferred to the storing section from an image reading unit 5. Data is also transferred to the image data storing section, for example, from a computer constructed on a network or the like.

In thus configured image formation apparatus A, the image reading unit 5 for reading an original document image is installed above the apparatus A, and further, a document feeding unit 6 is mounted on the unit 5. In the image reading unit 5, although not shown in the figure, inside a casing 7 are provided a platen for setting an original document sheet, a reading carriage for scanning the original document image along the platen, and a photoelectric conversion means for forming an image of reflected light from the original document image to perform photoelectric conversion. Further, the document feeding unit 6 is provided with a feeder mechanism (not shown in the figure) for dividing original document sheets set on a paper feed tray 9 on a sheet-by-sheet basis to automatically feed to the plate of the image reading unit 5.

[Sheet Post-Processing Apparatus]

The sheet post-processing apparatus B is built in the above-mentioned image formation apparatus A as described below. The image formation apparatus A described previously carries out the sheet with the image formed thereon to the sheet discharge path P2. With respect to the sheet discharge path P2, a sheet discharge area 21 is formed above the casing 1, and it is configured that the sheet with the image formed in the image formation section 3 is carried out to the sheet discharge area. The sheet discharge area 21 shown in the figure is arranged between the upper portion of the image formation apparatus A and the image reading unit 5 disposed above the apparatus A (see FIG. 1).

Then, a sheet discharge unit is installed inside the sheet discharge area 21, and the sheet post-processing apparatus B is configured to be installed inside the casing 1 as one of the unit. Further, the sheet discharge path P2 described above is provided with a transport roller 22 to carry out a sheet to the sheet discharge area 21, and feeds the sheet to a coupling opening 23 coupled to the sheet discharge unit.

The sheet post-processing apparatus (hereinafter, referred to as a "sheet discharge unit") B will be described below according to FIG. 2. The sheet discharge unit B is provided with a sheet discharge path (sheet discharge path of the sheet discharge unit; the same in the following) P3 coupled to the coupling opening 23 of the sheet discharge path P2, and a sheet discharge outlet 24 provided at the exit end of the path. The sheet discharge outlet 24 is provided with a pair of sheet discharge rollers 25 (25*a*, 25*b*), and the roller 25*b* shown in the figure is coupled to a driving motor (not shown in the figure). Further, in the sheet discharge path P3 of the sheet discharge unit, an eject path P4 is separated and configured via a path switching flapper 26, and an overflow stacker (not shown in the figure) is disposed on the downstream side of the eject path P4.

To the overflow stacker are carried out an overflow sheet, interrupt job sheet, etc. In the sheet discharge path P3, a carry-in sensor S1 and sheet discharge sensor S2 are disposed respectively in positions as shown in the figure, and the carry-in sensor S1 detects a sheet front end to control the subsequent path switching flapper 26, sheet discharge rollers 25, etc. Meanwhile, the sheet discharge sensor S2 is disposed in the sheet discharge outlet 24 or in the sheet discharge path P3 on the upstream side of the outlet 24, and detects the front end and rear end of the sheet to control a subsequent sheet discharge rotating body 35, aligning belt 40, etc.

Figure 3A:
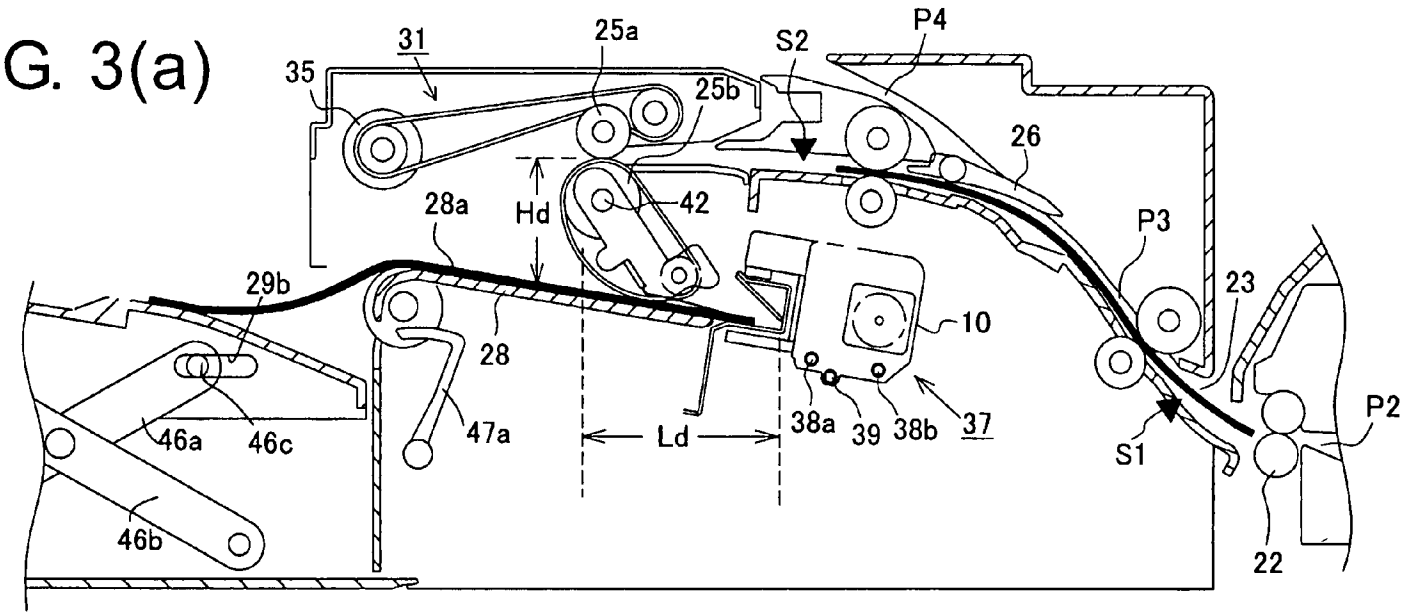
FIG. 3 contains explanatory views of a sheet discharge structure of the sheet discharge unit in FIG. 2, where FIG. 3(*a*) is an explanatory view of principal part, and FIG. 3(*b*) is an explanatory view of a specific structure of an aligning belt.
Figure 3B:
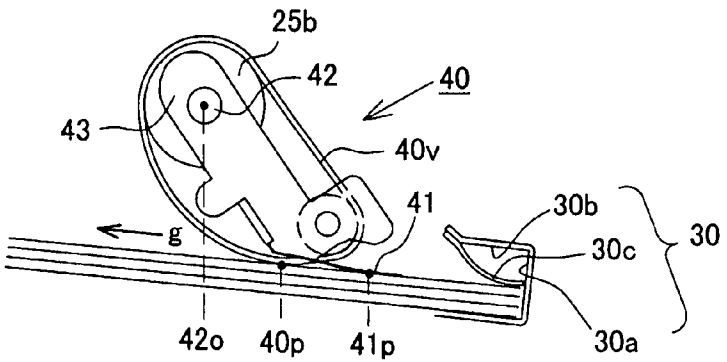

Meanwhile, a height difference Hd (see FIG. 3(*a*)) is formed on the downstream side of the above-mentioned sheet discharge outlet 24, a processing tray 28 is provided therein, and a stack tray 29 is disposed on the downstream side of the tray 28. The processing tray 28 and stack tray 29 are arranged in dimensions and shape such that the sheet from the sheet discharge outlet 24 is bridge-supported at the front end portion by the stack tray 29 and at the rear end portion by the processing tray 28. In other words, the processing tray 28 is configured in dimensions and shape shorter than the length in the sheet discharge direction of the minimum-size sheet, and supports the read end portion of the sheet of which the front end portion is supported by the stack tray 29. Hereinafter, the processing tray 28 and stack tray 29 will be described below in this order.

[Configuration of the Processing Tray]

As FIG. 3(*a*) shows the detailed configuration, the processing tray 28 is comprised of a tray member having a sheet mount surface 28*a*, and in the end portion of the sheet mount surface 28*a* is disposed a rear end regulation stopper (sheet end regulation means; the same in the following) 30. The sheet mount surface 28*a* is allowed to have either of shapes that the sheet is supported in a horizontal attitude and that the sheet is supported in an inclined attitude so that the sheet rear end side (rear end side in the sheet discharger direction; the same in the following) is lower.

The rear end regulation stopper 30 is disposed in a position spaced a distance Ld apart from the sheet discharge outlet 24, and is comprised of a stopper member having a sheet end regulation surface 30*a* for striking the sheet rear end edge to regulate, and a sheet rising regulation surface 30*b* for regulating rising of the sheet front end by curling. "30*c*" shown in the figure denotes a front end pressing piece for pressing and regulating the sheet front end, is made of an elastically deformable plate material, and fixed at the base end portion to the stopper member to press and correct the curled sheet front end (see FIG. 3(*b*)).

In the processing tray 28 are disposed a sheet transfer means 31 for transferring the sheet from the sheet discharge outlet 24 toward the rear end regulation stopper 30, and a side aligning means 32 for aligning the side edges of the sheet in the width. The sheet transfer means 31 is configured to be able to move up and down with respect to the sheet mount surface 28*a*. The structure is shown in FIG. 2(*b*), and the sheet transfer means 31 is comprised of a bracket (lifting/lowering support means; the same in the following) 34 that swings up and down, a sheet discharge rotating body (forward/backward rotation roller; the same in the following) 35 supported by the bracket 34, and lifting/lowering motor MS.

Figure 6:
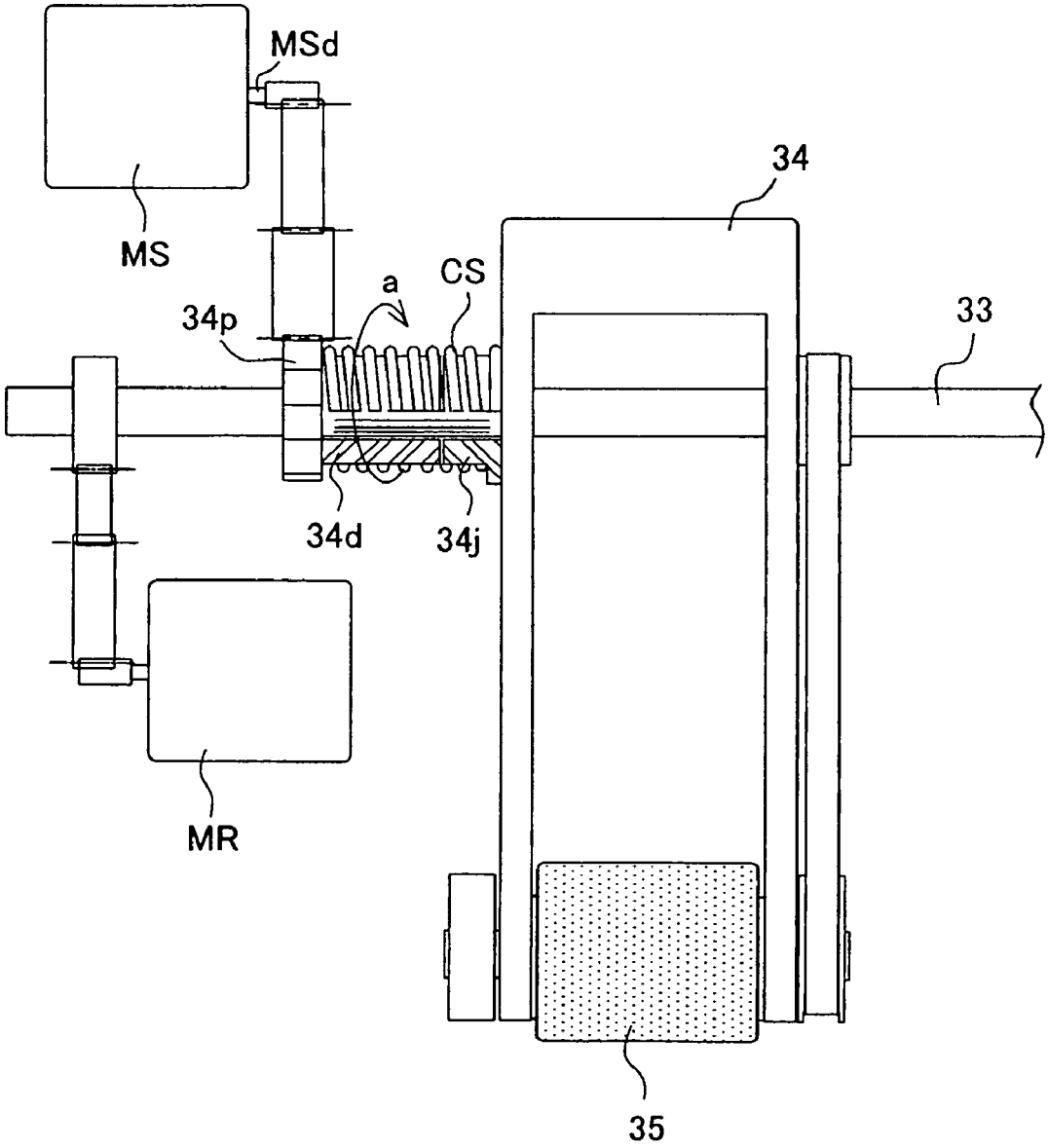
FIG. 6 is an explanatory view of the lifting/lowering mechanism of the sheet discharge rotating body in the sheet discharge unit in FIG. 2.

In the bracket 34, the base end portion is axially supported by an apparatus frame (not shown in the figure) on a swing rotary shaft 33, and the forward/backward rotation roller 35 is bearing-supported at the front end portion. Then, the forward/backward rotation roller 35 is coupled to a forward/backward rotation motor MR (shown in FIG. 6), and transfers the sheet leftward and rightward (sheet discharge direction and sheet-discharge opposite direction) viewed in FIG. 2. By this means, when the forward/backward rotation roller 35 rotates in the counterclockwise direction in FIG. 2(*b*), the sheet is transferred to the rear end regulation stopper 30 side, and when the roller 35 rotates in a clockwise direction, the sheet is transferred to the stack tray 29 side.

[Lifting/Lowering Mechanism of the Sheet Discharge Rotating Body]

The lifting/lowering mechanism of the above-mentioned sheet discharge rotating body (forward/backward rotation roller) 35 will be described according FIGS. 2(*b*) and 6. As shown in FIG. 2(*b*), the swing rotary shaft 33 is bearing-supported by the apparatus frame (not shown), and rotation of the forward/backward rotation motor MR is conveyed in gear to the swing rotary shaft 33 (see FIG. 6). Concurrently therewith, a driven-side collar 34*j* integrally formed at the base end portion of the bracket 34 is freely fitted and supported by the swing rotary shaft 33. Accordingly, irrespective of forward and backward rotation of the swing rotary shaft 33, the bracket 34 swings on the swing rotary shaft 33.

Meanwhile, a driving-side collar 34*d* is freely fitted and supported by the swing rotary shaft 33 adjoining to the above-mentioned driven-side collar 34*j*, and the driving-side collar 34*d* is coupled in gear to a driving shaft MSd of the lifting/lowering motor MS via a pinion 34*p*. Accordingly, the driving-side collar 34*d* rotates forward and backward by the driving shaft MSd of the lifting/lowering motor MS irrespective of rotation of the swing rotary shaft 33. Then, a clutch spring CS is wound around the driving-side collar 34*d* and driven-side collar 34*j*. The clutch spring CS is configured to be tightened by rotation in the direction shown by the arrow a in FIG. 6 of the driving-side collar 34*d*, while being relaxed by rotation in the opposite direction.

By this means, when the driving-side collar 34*d* is rotated in the direction shown by the arrow a by the lifting/lowering motor MS, the clutch spring CS is tightened, and the driven-side collar 34*j* rotates in the same direction. At this point, the bracket 34 integrally formed with the driven-side collar 34*j* moves up and shifts to a withdrawal position Wp from an operation position Fp. Then, when the bracket 34 moves to the beforehand set withdrawal position Wp, the bracket 34 strikes an upper limit stopper 34*u* (shown in FIG. 2), and thereafter, slips between the clutch spring CS and driven-side collar 34*j*, and the frictional force is set so that the rotation of the driving-side collar 34*d* is not conveyed to the driven-side collar 34*j*.

The setting of the frictional force is configured so that the bracket 34 is held in the withdrawal position Wp by the frictional force between the spring and the driven-side collar 34*j* in the state where the clutch spring CS is tightened, and does not move downward under its own weight. "34S" shown in FIG. 2(*b*) denotes a position sensor for detecting whether or not the bracket 34 is positioned in the withdrawal position Wp, and is configured integrally with the upper limit stopper 34*u*, and both of the sensor and stopper are attached to the apparatus frame.

Next, when the driving-side collar 34*d* is rotated in the opposite direction to the direction shown by the arrow a by the lifting/lowering motor MS, since the clutch spring CS is maintained at the tightened state, the bracket 34 moves downward from the withdrawal position Wp while following the rotation. The velocity at this point is controlled by rotation speed of the driving shaft MSd of the lifting/lowering motor MS.

Then, when the sheet discharge rotating body (forward/backward rotation roller) 35 supported by the front end portion of the bracket 34 comes into contact with the uppermost sheet on the processing tray 28, the clutch spring CS is relaxed by rotation (relaxing side in the opposite direction to the direction shown by the arrow a) of the driving-side collar 34*d*, and the bracket 34 rests in the operation position Fp of the sheet discharge rotating body 35 by slip rotation between the spring and driving-side collar 34*d*. During such a shift of the sheet discharge rotating body 35 from the withdrawal position Wp to operation position Fp, a control CPU 65 described later starts the forward/backward rotation motor MR, and rotates the sheet discharge rotating body 35 in the counterclockwise direction in FIG. 2(*b*) so as to transfer the sheet to the rear end regulation stopper 30 side.

Accordingly, the bracket 34 swings in the clockwise direction and in the counterclockwise direction on the swing rotary shaft 33 by forward and backward rotation of the lifting/lowering motor MS. In other words, when the pinion 34*p* rotates in the clockwise direction in FIG. 2(*b*), the forward/backward rotation roller 35 is positioned in the withdrawal position Wp separated from the sheet mount surface 28*a* in the chain-line state in FIG. 2(*b*), and when the pinion 34*p* rotates in the counterclockwise direction, the forward/backward rotation roller 35 is positioned in the operation position Fp coming into contact with the sheet mount surface 28*a* in the solid-line state in FIG. 2(*b*). Then, the rotation force in the forward/backward rotation direction is conveyed to the forward/backward rotation roller 35 from the forward/backward rotation motor MR (shown in FIG. 6) coupled to the swing rotary shaft 33.

In addition, the sheet mount surface 28*a* of the processing tray 28 is provided with a driven roller 36 in a position opposed to the forward/backward rotation roller 35. This forward/backward rotation roller 35 rotates in the counterclockwise direction in FIG. 2(*a*) by the forward/backward rotation motor MR when the sheet is transferred to the rear end regulation stopper 30 from the sheet discharge outlet 24, while rotating in the clockwise direction in FIG. 2(*a*) when post-processed sheets (bunch) are transferred to the stack tray 29 on the downstream side from the rear end regulation stopper 30, and the driven roller 26 is driven according to the transfer of the sheet.

[Aligning Means]

An aligning means 40 is disposed between the above-mentioned sheet transfer means 31 and rear end regulation stopper 30. The aligning means 40 shown in the figure works with the sheet transfer means 31, and transfers the sheet rear end carried out of the sheet discharge outlet 24 toward the rear end regulation stopper 30. Therefore, as shown in FIG. 3(*b*), the aligning means 40 is comprised of a ring-shaped belt 40*v* (aligning belt) and a swing lever 43 for moving up and down the belt 40*v* corresponding to a sheet load amount of the processing tray 28.

One end (upper end in FIG. 3) of the swing lever 43 is axially supported swingably by a rotary shaft 42 of the sheet discharge roller (driving-side roller) 25*b* as described previously, and one end of the belt 40*v* is wound around the sheet discharge roller 25*b*. Then, the front end of the belt is configured to sag to engage in the sheet on the processing tray 28. Accordingly, by driving the sheet discharge roller 25*b* to rotate, the belt 40*v* also rotates in a counterclockwise direction in FIG. 3(*b*), and the swing lever 43 swings on the rotary shaft 42 under its own weight.

To the aforementioned swing lever 43 is fixed a front end guide 41, together with the belt 40*v*. This front end guide 41 is formed of a film member (Mylar) for guiding the sheet rear end fed by the belt 40*v* toward the rear end regulation stopper 30. Then, the rotation center 42*o* of the rotary shaft 42, sheet engagement portion 40*p* of the belt 40*v* and sheet engagement portion 41*p* of the front end guide 41 are arranged a distance apart from one another in the order of the rotation center 40*o*, engagement portion 40*p* and engagement portion 41*p* in the sheet transfer direction (see FIG. 3(*b*)).

The aligning means 40 is configured as described above in the sheet post-processing apparatus. The configuration will be described specifically. As the aligning means 40, a friction rotating body 40*v* is provided to engage in the uppermost sheet carried onto the processing tray 28. The friction rotating body 40*v* is not limited to the belt as shown in the figure, and is capable of adopting various structures such as a sponge roller, rubber roller, rubber ring, and paddle member.

Figures 18A, 18B:
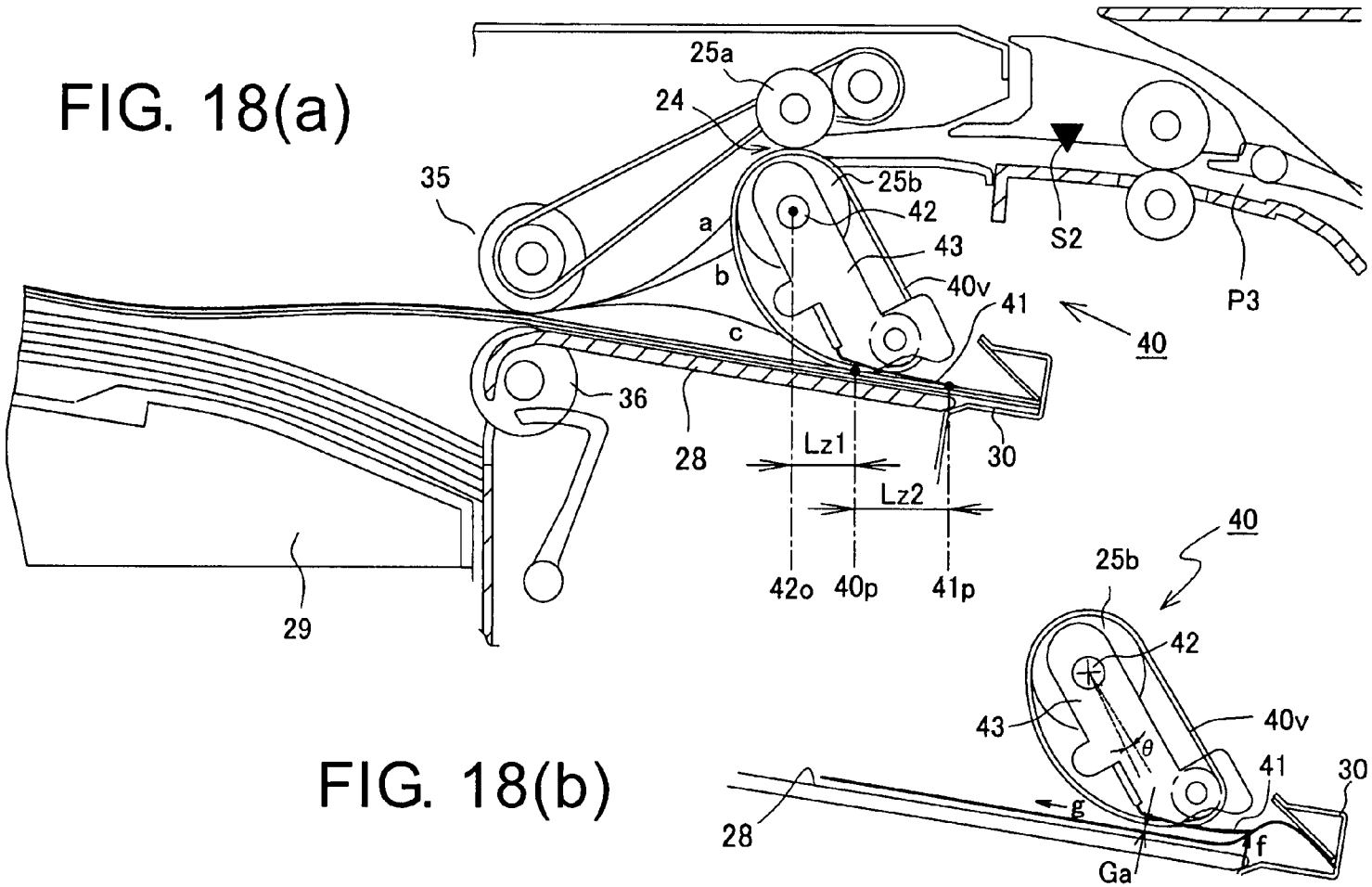
FIG. 18 contains explanatory views of an aligning means in the sheet discharge unit in FIG. 2, where FIG. 18(*a*) is an explanatory view of the entire configuration, and FIG. 18(*b*) is an explanatory view of principal part in the operation state.

The friction rotating member 40*v* is disposed between the sheet discharge outlet 24 and processing tray 28, and by the rotation, guides the sheet end portion shown by "a" in FIG. 18(*a*) to "b" and "c" in this order along the sheet mount surface 28*a* of the sheet discharge tray 28. Concurrently with the sheet rear end guide function, the friction rotating body 40*v* shifts the sheet between the body 40*v* and the sheet mount surface 28*a* to the rear end regulation stopper 30 side. The transport force adding function adds the transport force in cooperation with the sheet transfer means 31 as described previously so that the sheet smoothly arrives at the rear end regulation stopper 30 without skewing.

Therefore, the friction rotating body 40*v* presses the carry-in sheet, for example, under its own weight, and adds the transport force by the rotation. Concurrently therewith, the sheet engagement point 40*p* for adding the transport force needs to move up corresponding to the sheet load amount on the processing tray 28. Therefore, the friction rotating body 40*v* shown in the figure is supported by the swing lever 43 (which is not limited to the lever and may be a swing member). The swing lever 43 is axially supported swingably by the apparatus frame or the other member. The lever as shown in the figure is axially supported by the rotary shaft 42 of the sheet discharge roller 25*b*, and is configured to be swingably on the shaft.

Figure 7:
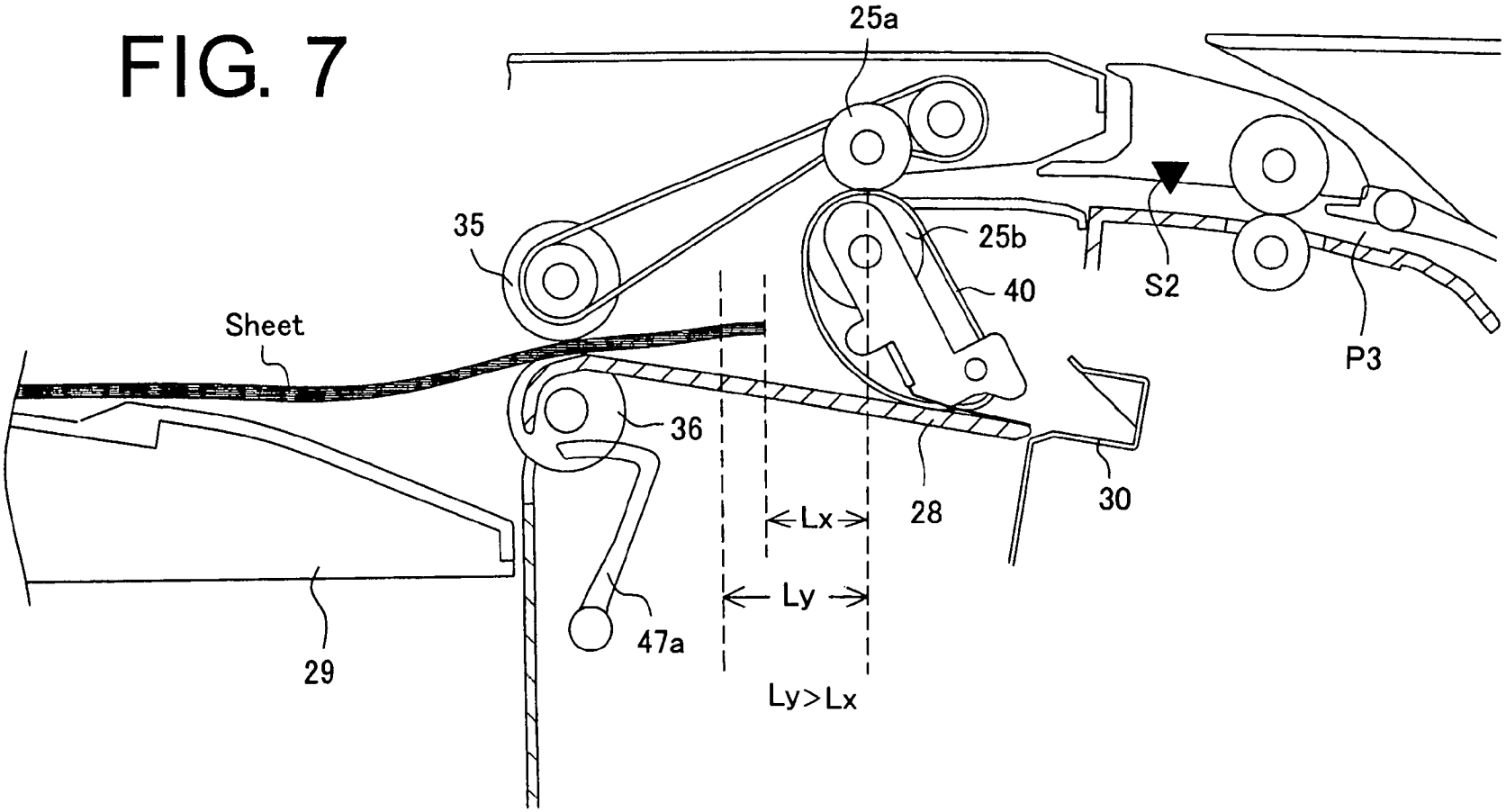
FIG. 7 is an operation explanatory view showing a state of a sheet that is carried out of the sheet discharge outlet in the sheet discharge unit in FIG. 2.

Then, in the sheet post-processing apparatus, the front end guide member 41 is provided between the friction rotating body 40*v* and the rear end regulation stopper 30 to guide the sheet front end to the stopper means. The front end guide member may be made of a film-shaped elastic piece such as Mylar as shown in the figure, or a sheet pressing plate of synthetic resin or metal. Then, this front end guide member 41 is configured to be swingably on the spindle. This is because of moving up the member 41 corresponding to the sheet load amount of the sheet mount surface 28*a*. Then, a swing member for swingably supporting the front end guide member 41 is fixed and supported at the base end portion of the front end guide member 41 by the swing lever together with the friction rotating member 40*v* in the Embodiment as shown in FIG. 7.

Accordingly, the swing lever 43 swingable on the rotary shaft 42 supports the friction rotating body 40*v* and the front end guide member 41. Then, the rotation center 42*o* of the rotary shaft 42, sheet engagement point 40*p* of the friction rotating body 40*v* and sheet engagement point 41*p* of the front end guide member 41 are arranged in this order from the upstream side to the downstream side in the sheet transfer direction. In other words, as shown in FIG. 18(*a*), the rotation center 42*o* and the engagement point 40*p* are arranged a distance (Lz1) apart from each other, and the engagement point 40*p* and the engagement point 41*p* are arranged a distance (Lz2) apart from each other.

Accordingly, when excessive transport force is applied to the sheet from the sheet transfer means 31 as described above, after the sheet rear end strikes the rear end stopper 30 as shown in FIG. 3(*b*), the force for curving the sheet in loop form acts on the sheet. When the sheet transfer means 31 and the aligning belt 40*v* continue to transport the sheet to the stopper side regardless of the curving deformation force acting on the sheet, the sheet rear end becomes deformed locally, and wrinkles and/or front end bending occur.

However, when the rising force acts on the front end guide member 41 from the sheet rear end as described above, rotation moment on the rotary shaft 42 acts on the swing lever 43, and by the moment, the swing lever 43 rotates in a counterclockwise direction in FIG. 3(*b*). Due to the rotation, a gap arises between the aligning belt 40*v* and sheet upper surface. By thus formed gap, the sheet does not curve in loop form, and extends in the direction shown by the arrow g. By this means, it is possible to prevent the occurrence of wrinkles in the sheet rear end portion and front end bending.

[Different Embodiment of the Aligning Means]

Figures 19A, 19B:
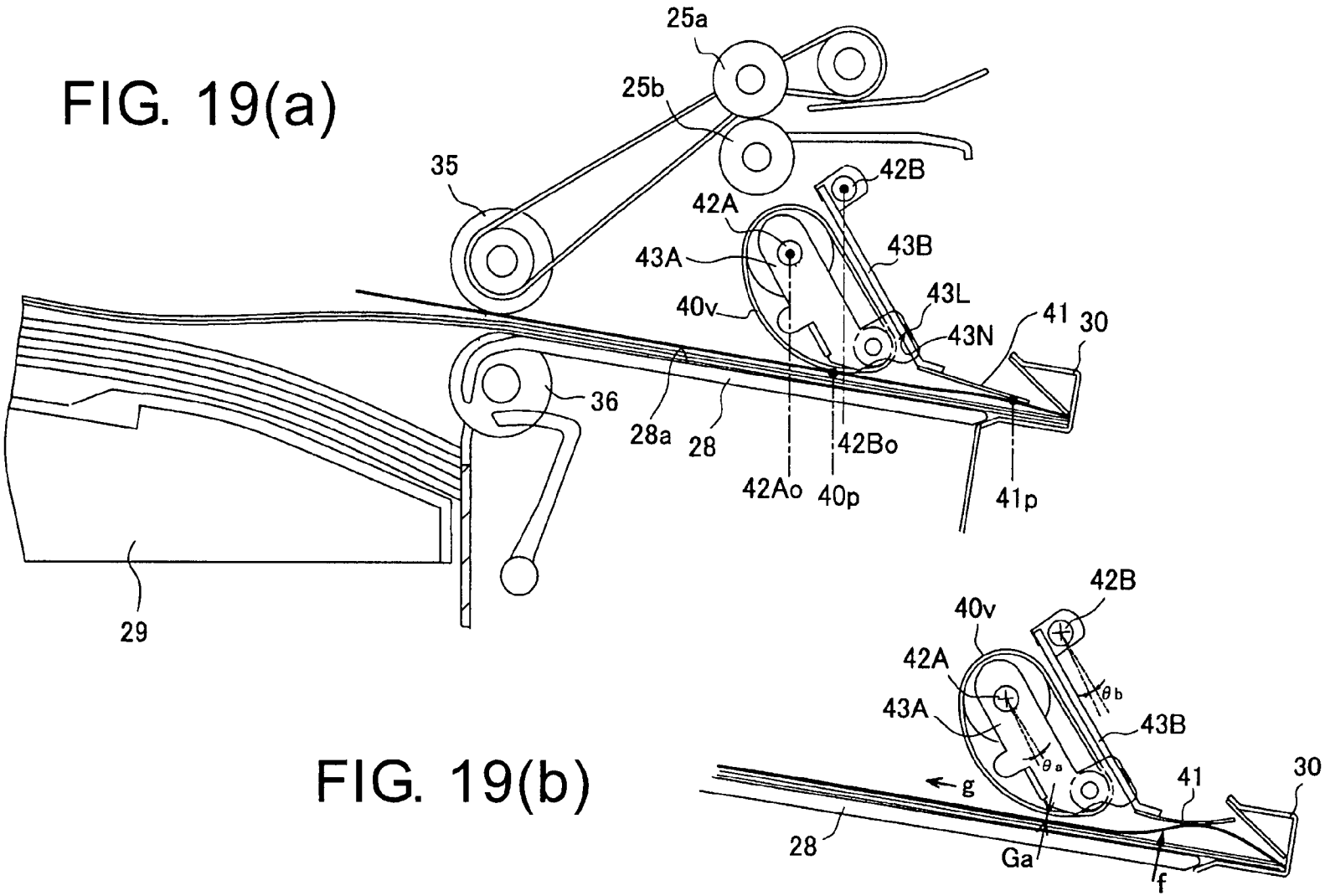
FIG. 19 shows the aligning means in the sheet discharge unit in FIG. 2, and is an explanatory view of an Embodiment different from FIG. 18.

Next, an Embodiment as shown in FIG. 19 illustrates the case that the friction rotating body 40*v* is supported by a first swing lever 43A and that the front end guide member 41 is supported by a second swing lever 43B. The same configuration as in FIG. 18 is assigned the same reference numeral. The friction rotating body 40*v* is comprised of a belt, roller or the like as in the body 40*v* described previously, and is supported rotatably by the first swing lever 43A. Then, to the friction rotating body 40*v* is conveyed rotation in the direction for transferring the sheet to the rear end regulation stopper 30 side from a driving motor not shown. As the driving motor, the force may be conveyed from the rotary shaft of the sheet discharge roller 25*b*, or an independent driving motor may be provided.

The above-mentioned first swing lever 43A is axially supported by the apparatus frame swingably on a rotary shaft 42A. Accordingly, the friction rotating body 40*v* moves up and down on the rotary shaft 42A, and the sheet engagement point 40*p* engaging in the uppermost sheet (carry-in sheet) on the processing tray 28 moves up and down corresponding to the load amount.

Meanwhile, the front end guide member 41 is comprised of a plate-shaped sheet pressing piece of metal, resin or the like, the base end portion is fixed to the second swing lever 43B, and the front end portion is disposed between the friction rotating body 40*v* and rear end regulation stopper 30. The second swing lever 43B is axially supported by the apparatus frame swingably on the rotary shaft 42B, and the sheet engagement point 41*p* of the front end guide member 41 moves up and down corresponding to the load amount of sheets.

Then, the above-mentioned second swing lever 43B and first swing lever 43A are coupled to each other to covey the swing of the second swing lever 43B to swing movements of the first swing lever 43A. This coupling may be made by coupling both levers with a coupling pin, for example, and in the levers as shown in the figure, a fold piece 43L is formed in the first swing lever 43A, and is coupled to a coupling portion 43N of the second swing lever 43B to engage in each other. Accordingly, when the second swing lever 43B swings on the rotary shaft 42B in a counterclockwise direction shown in the figure, the coupling portion 43N pushes upward the fold piece 43L of the first swing lever 43A. By this means, the swing lever 43A also swings on the rotary shaft 42A in the same direction.

Also in this Embodiment, as in the Embodiment described previously, the rotation center 42Ao of the first swing lever 43A, sheet engagement point 40*p* of the friction rotating body 40*v* and sheet engagement point 41*p* of the front end guide member 41 are arranged a distance apart from one another in this order from the upstream side in the sheet transfer direction. Then, the rotary shaft center 42Bo of the second swing lever 43B is disposed in a position a distance apart from the sheet engagement point 41P of the front end guide member 41 on the upstream side or downstream side in the sheet transport direction. This is because of making the relationship that the rising force of the sheet acting on the sheet engagement point 41*p* produces the rotation moment of the rotation center 42Bo in the second swing lever 43B.

In thus configured aligning means 40, when excessive transport force acts on the sheet from the sheet transfer means 31 as described above due to a reason as described later, after the sheet rear end strikes the rear end regulation stopper 30 as shown in FIG. 19(*b*), the sheet rear end is acted upon by force of curving in loop form. Due to the deformation of the sheet, when the rising force "f" acts on the front end guide member 41, the rotation moment on the rotary shaft 42B acts on the second swing lever 43B.

By the moment, the second swing lever 43B rotates in a counterclockwise direction in FIG. 19(*b*) by angle θb. The rotation of the second swing lever 43B is conveyed to the first swing level 43A from the above-mentioned coupling portion 43N, and the first swing lever 43A rotates in the counterclockwise direction in the figure on the rotary shaft 42A by angle θa. Due to the rotation, a gap Ga arises between the friction rotating body 40*v* and the sheet upper surface. By thus formed gap Ga, the sheet does not curve in loop form, and extends in the direction shown by the arrow g. By this means, it is possible to prevent the occurrence of wrinkles in the sheet rear end portion and front end bending, as in the Embodiment described previously.

Described next is the reason of above-mentioned excessive transport of a sheet by the sheet transfer means 31. The sheet transfer means 31 described previously is disposed on the processing tray 28, and is configured to move up and down between the withdrawal position Wp and operation position Fp. Then, in the sheet discharge path P3 is disposed the sheet discharge sensor S2 on the upstream side of the sheet discharge outlet 24.

Then, in carrying out a sheet onto the processing tray 28 from the sheet discharge rollers 25 of the sheet discharge path P3, as described based on FIG. 3, the sheet transfer means 31 is positioned in the withdrawal position Wp in carrying out a sheet onto the processing tray 28 from the sheet discharge outlet 24. Therefore, after the sheet rear end is passed through the sheet discharge outlet 24, the sheet is dropped onto the processing tray 28 by its inertia. Hence, a thick sheet with large basis weight (mass) or sheet with one-sided printing lands in a farther position from the sheet discharge outlet 24, while a thin sheet with small basis weight (mass) or two-side printed sheet with a low coefficient of surface friction lands in a closer position from the outlet 24.

Thus, the distance between the sheet rear end and the rear end regulation stopper 30 varies on a sheet-type basis. Then, to prevent the sheet rear end from not reaching, the need arises of setting a transfer amount of the sheet by the sheet transfer means 31 and the aligning means 40 at an overrun. When the sheet is thus excessively transported, it is necessary to set transport conditions such that a slip occurs between the sheet and the friction rotating body 40*v*. The transport conditions lead to a problem of resulting in skewing of the sheet. Therefore, in striking the sheet against the rear end regulation stopper 30 by the above-mentioned friction rotating body 40*v* to transport, the problem arises that the sheet end portion is curved in loop form.

[Side Aligning Means]

In the above-mentioned processing tray 28 is disposed the side aligning means 32 for regulating the positions of side edges of the sheet positioned in the rear end by the rear end regulation stopper 30. The side aligning means 32 is configured to align the sheet side edges in the width in a reference position using either of the center reference for positioning with reference to the center of the sheet that is carried in the processing tray 28 from sheet discharge outlet 24, and the side reference for positioning with reference to one of right and left edges of the sheet.

Figure 5A:
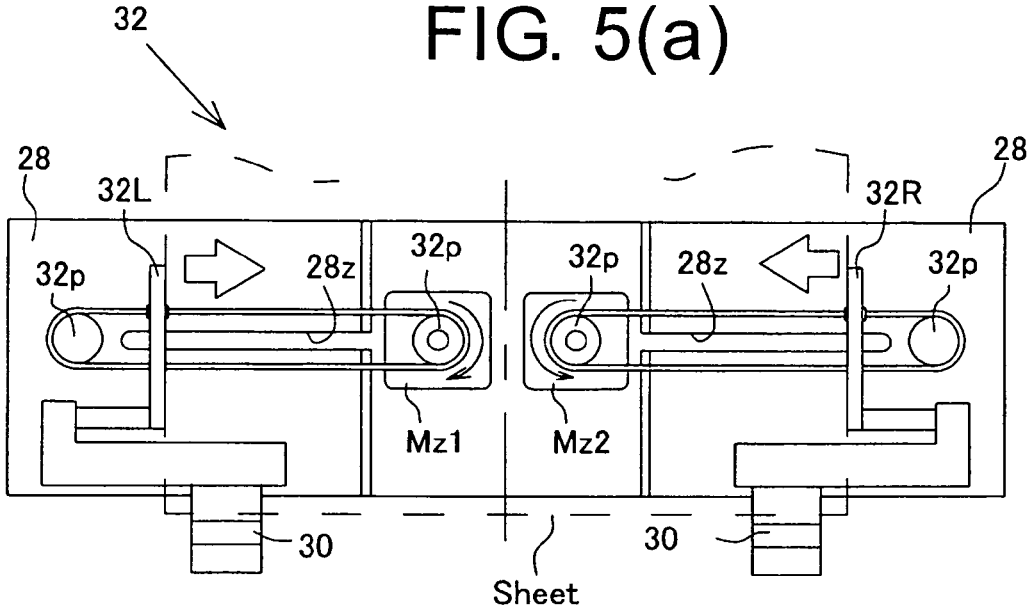
FIG. 5 contains explanatory views of a side alignment mechanism in the sheet discharge unit in FIG. 2, where FIG. 5(*a*) is an explanatory view of a bottom structure of the processing tray, and FIG. 5(*b*) is an explanatory view of a sheet mount surface of the processing tray.
Figure 5B:
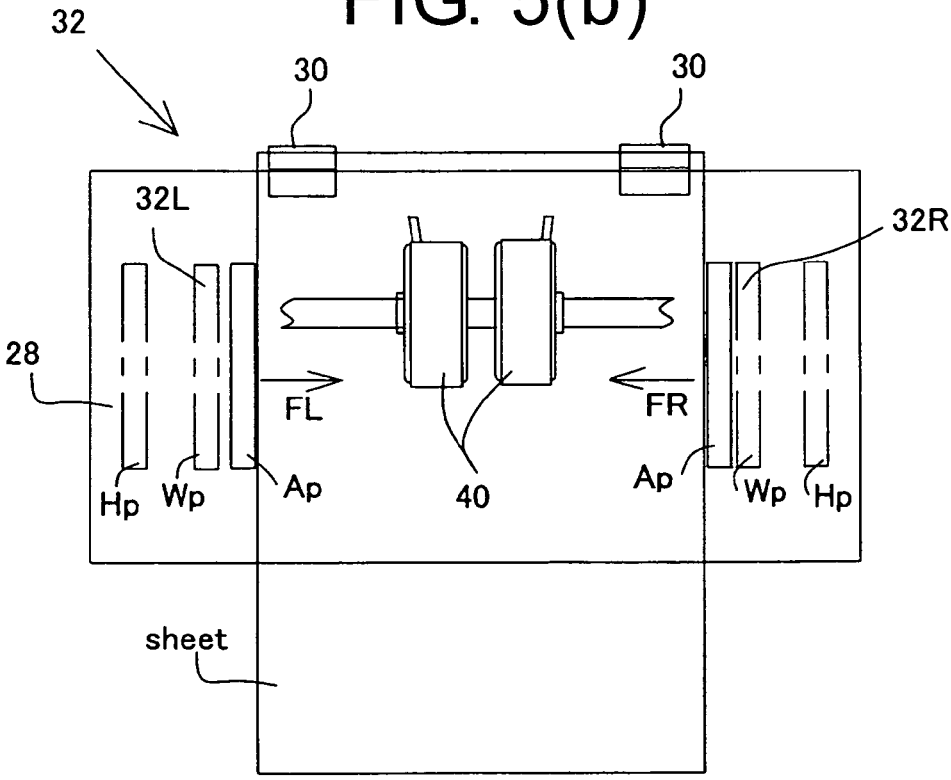

As shown in FIG. 5, the side aligning means 32 is comprised of a left aligning plate 32L for engaging with the left edge of a sheet that is carried in the processing tray 28, a right aligning plate 32R for engaging with the right edge of the sheet, and aligning motors Mz1, Mz2 for moving positions of the aligning plates in the orthogonal direction to the sheet discharge direction. Each of the left and right aligning plates 32L, 32R is fitted and supported by a slit groove 28*z* formed in the sheet mount surface 28*a* of the processing tray, and is able to move to positions in the sheet width direction. A pair of pulleys 32*p* are disposed in the tray bottom along the slit groove 28, and a belt 32*v* is looped over the pulleys 32*p*. Each of the left and right aligning plates 32L, 32R is fixed to the belt 32*v*, while one of the pulleys 32*p* is coupled to the aligning motor Mz1 or Mz2.

When the aligning motors Mz1, Mz2 are rotated in the opposite direction by the same amount, the left and right aligning plates 32L, 32R approach and separate from the sheet center. Then, in each of the left and right aligning plates 32L, 32R is disposed a position sensor (not shown in the figure) in a beforehand set home position, and in starting the apparatus, the aligning plates 32L, 32R are positioned in the home positions Hp. Then, the control means (control CPU) 65 described later receives size information of the sheet from the image formation apparatus A, and based on the information, moves the left and right aligning plates 32L, 32R to predetermined withdrawal positions (FIG. 5(*b*) Wp) to wait. The withdrawal positions Wp are set in positions (positions for forming an aligning operation width) spaced a predetermined amount apart from the width size of the sheet that is carried in the processing tray 28.

Then, the control means (control CPU) 65 rotates the left and right aligning motors Mz1, Mz2 in the opposite directions by a predetermined amount in synchronization with each other after a lapse of predicted time the rear end of a sheet that is carried in from the sheet discharge outlet 24 arrives at the rear end regulation stopper 30, and moves the left and right aligning plates 32L, 32R to the alignment positions (FIG. 5(*b*) Ap). By this means, the sheet carried onto the processing tray is aligned in the width. In other words, the control means 65 described later is configured to control the aligning motors Mz1, Mz2 so as to move the positions of the left and right aligning plates 32L, 32R among the home positions Hp, waiting position Wp and alignment positions Ap.

Therefore, the sheet post-processing apparatus controls the side aligning means 32 configured as described above in the following manner. The control means (specifically described later) 65 (see FIG. 9) for controlling the above-mentioned side aligning means 32 is configured to move the side aligning members (left and right aligning plates 32L, 32R) to the alignment positions Ap from the waiting positions Wp after the predetermined number of sheets is discharged on the processing tray 28 from the sheet discharge outlet 24 so as to execute the aligning operation. Then, the predetermined number of sheets (hereinafter, the number of alignment sheets) is set corresponding to the properties of the sheets.

Herein, the number of alignment sheets is described. It is well known that the nerve varies with the properties of the sheet. As the "nerve", when the basis weight (mass per unit area) of the sheet is large, the sheet thickness is generally thick, and concurrently, the nerve is defined as being high. On the other hand, when the capacity basis weight (mass per unit area) of the sheet is small, the sheet thickness is thin, and concurrently, the nerve is defined as being low. Then, when the nerve of the sheet is low, as shown in FIG. 5(*b*), in the sheet, the aligning force FR from the right aligning plate 32R and the aligning force FL from the left aligning plate 32L act on the left and right side edges, respectively. Further, in the sheet, the aligning means 40 works as a load in the center portion, and therefore, the tendency occurs that the sheet opposite side portions curl to rise upward.

Meanwhile, when the nerve is high, similarly, the aligning forces FL, FR act from the left and right, and the load of the aligning means 40 is imposed on the center portion. Then, since the nerve of the sheet is high, unless the aligning forces are adequately stronger than the aligning load, the aligning plates stop in the positions, and by subsequent operation, return to the waiting points Wp. Thus, when the load acting on the sheet exceeds the aligning forces, the load is excess, and the phenomenon occurs that the sheet is not aligned in a normal attitude.

Therefore, the inevitability arises of configuring the left and right aligning plates 32L, 32R, and aligning motors Mz1, Mz2 for driving the plates so as to act mechanically sufficiently higher aligning forces than the load of the aligning means 40. In such an alignment mechanism, in sheets with the low nerve (for example, sheets of 45 grams or less) or already curled sheets, rising curls frequently occur in the sheet opposite side portions.

Therefore, in the sheet post-processing apparatus, for sheets with the beforehand set basis weight (reference value) or less, after the predetermined number "b" (for example, two sheets; b>2) of sheets is carried onto the processing tray 28, the aligning means 32 concurrently aligns the plurality of sheets in the width. Then, when the basis weight of the sheet exceeds the reference value, in a stage that the predetermined number (a) (for example, one sheet; a<b) of sheets is carried onto the processing tray 28, the aligning means 32 aligns the sheet in the width.

The relationship between the "high-nerve sheet" and "low-nerve sheet" is established also similarly in the width size of the sheet. In other words, sheets of small width sizes have the high nerve in the width direction, and sheets of large width sizes have the low nerve. Therefore, in sheets of a predetermined width size (reference value) or more, after the predetermined number "b" (for example, two sheets; b>2) of sheets is carried onto the processing tray 28, the side aligning means 32 concurrently aligns the plurality of sheets in the width. Then, when the sheet width size is less than the reference value, in a stage that the predetermined number (a) (for example, one sheet; a<b) of sheets is carried onto the processing tray 28, the side aligning means 32 aligns the sheet in the width. In this case, the reference value of the sheet width size is preferably set using a standard value such as a JIS A4 width size.

Further, the above-mentioned relationship between the "high-nerve sheet" and "low-nerve sheet" is similarly established in the size in the discharge direction of the sheet. In other words, in sheets of small sizes in the sheet discharge direction, since the major portion is supported on the processing tray, the twist phenomenon does not occur between the upstream portion and downstream portion of the sheet in the width alignment by the aligning plates 32L, 32R. In other words, it is said that the nerve of the sheet in the discharge direction is high.

In contrast thereto, in sheets of large sizes in the sheet discharge direction, since the rate of the downstream portion that does not undergo resistance of the transport means such as the guide and belt on the stack tray becomes higher relative to the upstream portion that undergoes resistance of the transport means such as the guide and belt on the stack tray, even a single sheet, the twist phenomenon occurs between the upstream side hard to move in the width alignment by the aligning plates 32L, 32R and the downstream side easy to move, and the problem of being easy to skew occurs. In other words, it is said that the nerve of the sheet in the discharge direction is low.

Accordingly, in sheets low in the nerve in the sheet discharge direction such that the length in the sheet discharge direction is a reference value or more, two or more, a plurality of sheets is aligned concurrently. Meanwhile, in sheets high in the nerve in the sheet discharge direction such that the length in the sheet discharge direction is less than the reference value, a single sheet (or a<b) is aligned in the width. In this case, the reference value of the sheet size is preferably set using a standard value such as a JIS A4 vertical size.

[Post-Processing Means]

A post-processing means 37 disposed on the above-mentioned processing tray 28 will be described. As shown in FIG. 3(*a*), the post-processing means 37 is built in a casing 8 of the sheet discharge unit B to perform post-processing on sheets (bunch) that are struck and regulated against the rear end regulation stopper 30. The post-processing means 37 as shown in the figure is comprised of a stapler means. The stapler means (apparatus) is well known and specific descriptions thereof are omitted. Each of staple needles (blanks)

coupled in band form stored in a cartridge is folded in the shape of a U and inserted in a sheet bunch with a driver member. The means is comprised of a unit for folding the needle tip with an anvil member disposed to oppose the driver member.

On the unit frame 10 are mounted a driving corn and stapler motor, and the driver member is lowered with a designation signal from the post-processing control section (control CPU) 65 described later to execute the stapling operation. The above-mentioned unit frame 10 is fitted and supported by guide rails 38*a*, 38*b* slidably and is configured to move to positions in the width direction of the sheets (bunch) on the processing tray 28. Further, a screw shaft 39 is disposed and fixed to the unit frame 10, and moves the stapler means (post-processing means) 37 to positions in the sheet width direction with a driving motor not shown.

[Configuration of the Stack Tray]

The configuration of the stack tray 29 will be described. As the entire configuration is shown in FIG. 2(*a*), the stack tray is disposed on the downstream side of the processing tray 28, and is comprised of a tray member that moves up and down corresponding to a load amount of sheets. As the entire configuration is shown in FIG. 2, the stack tray 29 (tray member; the same in the following) having a mount surface 29*a* to mount sheets is supported by a tray frame 44 fixed to the apparatus frame to be able to move up and down.

The lifting/lowering mechanism of the above-mentioned tray member 29 will be described. Provided are a pair of link levers 46*a*, 46*b* coupled to each other by a spindle 45, and the base end portion of each of the levers is axially supported swingably by the tray frame 44.

Then, the stack tray 29 is supported in slit-pin coupling by the front end portions of the link levers 46*a*, 46*b*. Fit slits 29*a*, 29*c* are provided on the stack tray side, and the front end portions of the link levers 46*a*, 46*b* are coupled to the slits by pins 46*c*, 46*d*. Then, the spindle shaft of one of the link levers, 46*a*, is coupled in gear to a lift motor ML via a worm gear. Accordingly, the link lever 46*a* swings leftward and rightward viewed in FIG. 2 by forward and backward rotation of the lift motor ML, the link lever 46*b* swings in the opposite direction by the same amount following the lever 46*a*, and the stack tray 29 moves up and down in a parallel attitude. The above-mentioned stack tray 29 is provided with a sheet surface detecting means 47 for detecting a sheet surface position.

[Configuration of the Sheet Surface Detecting Means]

Figure 4:
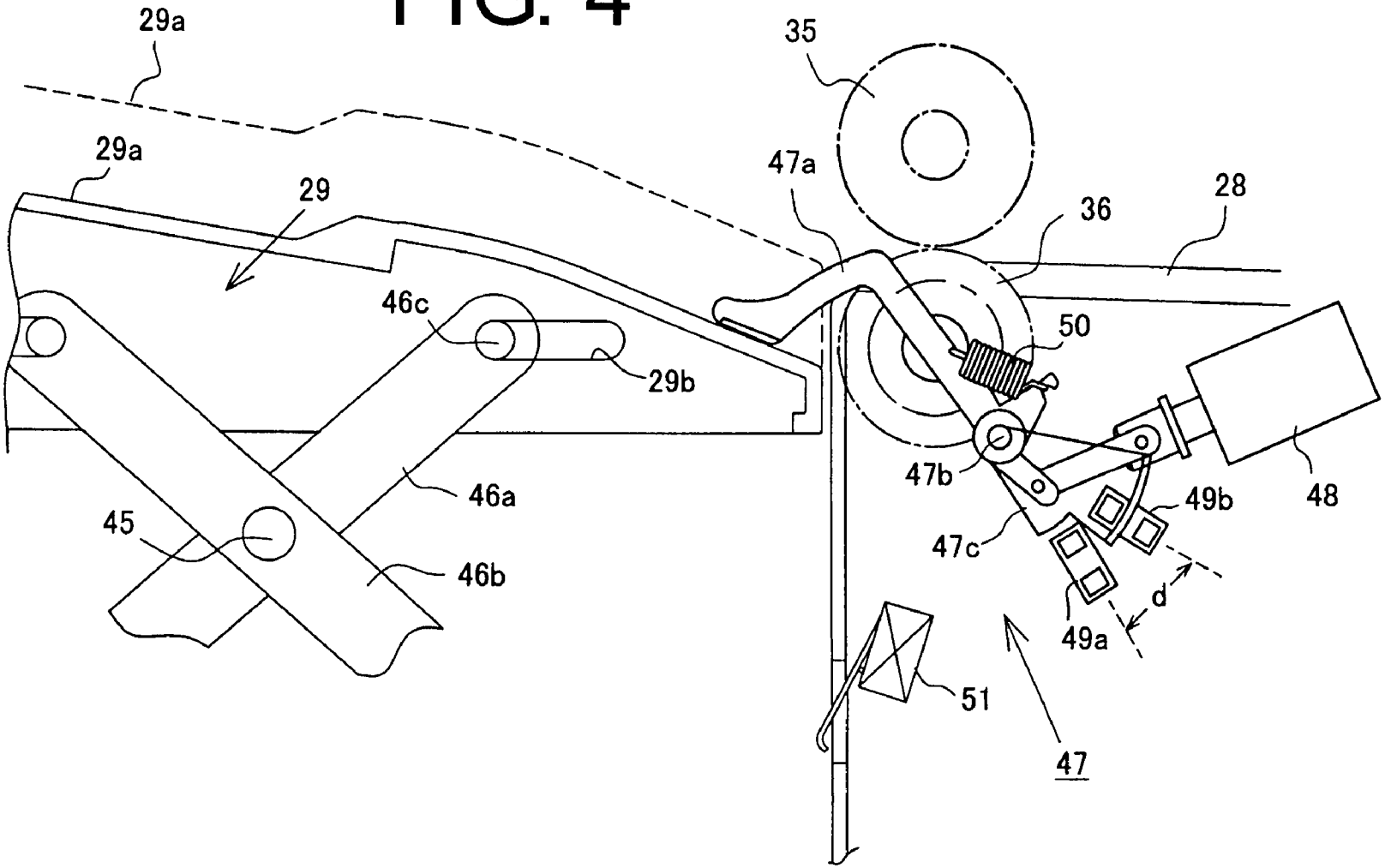
FIG. 4 is an explanatory view of a sheet surface detecting structure of a stack tray in the sheet discharge unit in FIG. 2.

FIG. 4 shows the configuration of the sheet surface detecting means 47. The means 47 is disposed in a sheet carry-in entrance (right end in FIG. 4) of the stack tray (tray means) 29, and detects a position of the uppermost surface of sheets piled on the mount surface 29*a*. Therefore, the means 47 is comprised of a sheet surface detecting lever 47*a* coming into contact with the uppermost sheet, an operation solenoid 48 for withdrawing the sheet surface detecting lever 47*a* from the mount surface 29*a* in carrying in the sheets, and bringing the lever 47*a* into contact with the sheet surface after carrying in the sheets, and first and second sensors 49*a*, 49*b* for detecting a position of a flag 47*c* of the sheet surface detecting lever 47*a*. The sheet surface detecting lever 47*a* is supported swingably by a spindle 47*b* on the apparatus frame, and is always biased to the withdrawal position side by a spring 50. The above-mentioned sheet surface detecting lever 47*a* is configured to withdraw out of the tray from the sheet surface in carrying the sheets onto the stack tray, and come into contact with the uppermost sheet after carrying in the sheets.

The above-mentioned sheet surface detecting lever 47*a* is provided with the spring 50 for always biasing to the withdrawal position side, and the above-mentioned operation solenoid 48 is configured to shift the sheet surface detecting level 47*a* to the operation position coming into contact with the sheet surface on the tray from the withdrawal position against the spring so as to detect a sheet surface position of the uppermost sheet on the tray at this point. The sheet surface detecting lever 47*a* is integrally provided with the flag 47*c*, and the first sensor 49*a* and second sensor 49*b* detect ON-OFF of a rotation displacement of the flag 47*c*.

Then, the sheet surface detecting lever 47*a* shifts from the withdrawal position to the detecting position (solid-line state in FIG. 4) against the above-mentioned spring 50 by the operation solenoid 48, is configured to detect the position of the uppermost sheet surface on the stack tray at this point, and is integrally installed at the lever base end portion with the flag 47*c*. As shown in the figure, the flag 47*c* is comprised of a detection plate in the shape of a sector, and the first sensor 49*a* and second sensor 49*b* for detecting the position of the flag 47*c* are arranged a distance d apart from each other. Then, in the aforementioned first and second sensors 49*a*, 49*b* and flag 47*c*, the position when the first sensor 49*a* is "OFF" and the second sensor 49*b* is "ON" as shown in FIG. 4 is set as a home position. Accordingly, when both of the first and second sensors are "ON", since the detected sheet surface is too high, the stack tray 29 is lowered by a predetermined amount. Meanwhile, when both of the first and second sensors are "OFF", since the detected sheet surface is too low, the stack tray 29 is lifted by a predetermined amount. By such control, it is possible to position the sheet surface level of the uppermost sheet loaded on the stack tray (tray member) 29 in the beforehand set home position. In addition, "51" shown in the figure denotes a lower-limit sensor for detecting a low-limit position of the stack tray 29.

The mount surface 29*a* of the above-mentioned stack tray is moved up and down with a detection signal of the above-mentioned sheet surface detecting means 47. UP-and-down lifting/lowering of the tray is made by controlling the lift motor ML as described previously. For example, when the lift motor ML is comprised of a DC motor, the rotation amount is controlled by time of power supply to the motor, or an encoder is provided in the motor rotary shaft, and the rotation amount is controlled by encoder pulse. Meanwhile, when the lift motor is comprised of a pulse motor, the rotation amount is controlled by power supply pulse.

[Height Control of the Stack Tray]

Then, in the apparatus, the height position of the stack tray 29 is set at, at least two height positions, first height position (Th1) and second height position (Th2). The case of setting the tray height position (Th) in two stages will be described below, but is the same as in the case of setting the height in three or more stages.

Figure 12A:
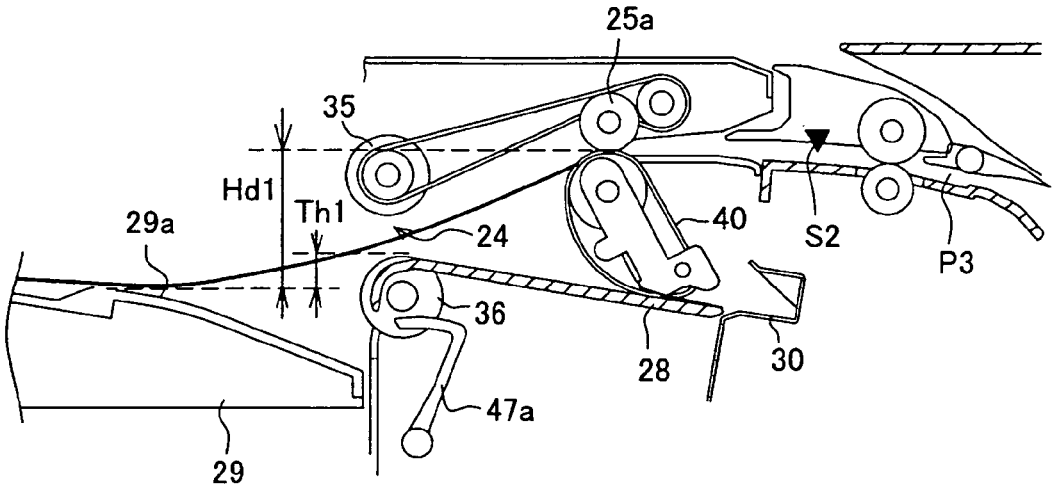
FIG. 12 contains explanatory views of height position adjustments of the stack tray in the sheet discharge unit in FIG. 2, where FIG. 12(*a*) shows a first height position, and FIG. 12(*b*) shows a second height position.
Figure 12B:
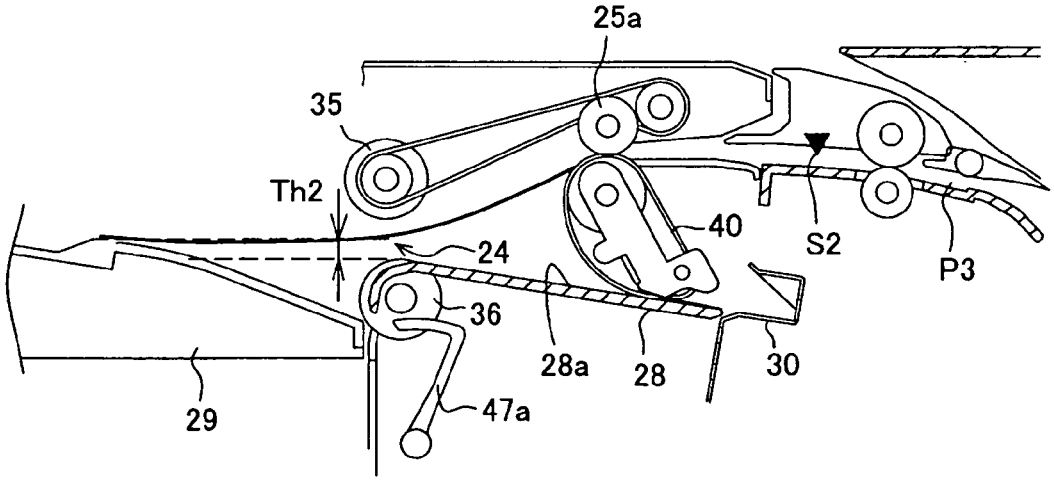

Therefore, the first height position (Th1) is set with reference to a sheet (hereinafter, referred to as an extremely thin sheet, although the conditions will be described later) with the lowest nerve to use, and is set at a height position such that a drop difference Hd1 for the sheet rear end not to remain in the sheet discharge guide or aligning belt 40*v* after the sheet is passed through the sheet discharge outlet 24 is formed between the sheet discharge outlet 24 and the mount surface 29*a*, as shown in FIG. 12(*a*). This height position is obtained by experiments.

Similarly, the second height position (Th2) is set with reference to a sheet (hereinafter, referred to as an extremely thick sheet) with the highest nerve to use, and is set at a height position such that after the front end of the sheet arrives at the mount surface 29*a* and the rear end is passed through the sheet discharge outlet 24, the sheet rear end is curved in bow form, and drops to the sheet mount surface 28*a* of the processing tray 28 under the never of the sheet itself, as shown in FIG. 12(*b*). As the height position, the height conditions that the sheet is reliably stored on the processing tray without the rear end remaining are obtained by experiments while varying the environmental conditions.

The nerve of the sheet will be described next. Although the nerve varies with the sheet properties of the sheet, when the basis weight (weight per unit area) of the sheet is large, the sheet is thick, and the nerve is high. For example, when the sheet quality is the same, the basis weight (weight) of the sheet, sheet thickness and the nerve of the sheet are approximately in the proportional relationship. Therefore, when the basis weight of (weight) of the sheet is large and the height level of the mount surface 29*a* is set to be low, the front end of the sheet is locked on the uppermost sheet on the mount surface 29*a* by friction, and the rear end curves in bow form while climbing over the sheet discharge guide or aligning belt 40*v*. When this phenomenon appears, neither the aligning belt 40*v* nor the forward/backward rotation roller 35 can mount the sheet on the processing tray in a correct attitude. Accordingly, a sheet jam occurs.

Similarly, when the basis weight (weight) of the sheet is small, the sheet is thin, and the nerve is low. Then, when the basis weight (weight) of the sheet is low and the height level of the mount surface 29*a* is set to be high, the sheet is transported while the front end rises along the mount surface 29*a*. Therefore, the transport force applied to the sheet from the sheet discharge rollers 25 is reduced. Then, when the sheet rear end is passed through the sheet discharge outlet 24, the sheet is fed to the stack tray side by its inertia force, but since the inertia force is reduced, the sheet rear end stops on the sheet discharge guide of the sheet discharge outlet 24 or aligning belt 40*v*.

Therefore, the sheet post-processing apparatus is characterized by setting the height position of the stack tray 29 at the first height position (Th1) such that even the sheet with the low nerve (sheet with the small basis weight) does not remain and at the second height position (Th2) such that even the sheet with the high nerve (sheet with the large basis weight) does not remain corresponding to the basis weight (weight) of the sheet.

As can be seen from the aforementioned descriptions, in the sheet post-processing apparatus, when the height position of the stack tray 29 is selectively set at a plurality of, first and second, height positions, selecting a height position from the basis weight (weight) of the sheet and selecting a height position from the thickness of the sheet is substantially the same in terms of comparison in the nerve of the sheet. In other words, almost the same results are obtained by selecting the first and second height positions Th1, Th2 from the basis weight information of the sheet or by selecting the first and second height positions Th1, Th2 from the thickness information of the sheet.

Then, the "basis weight information of the sheet" is input from a control panel 64 described later when an operator prepares sheets for paper cassettes 11*a*, 11*b* in the image formation apparatus A as described previously, and a control section 60 in the image formation apparatus stores this input information. Then, the control section 60 is configured to transfer the "basis weight information" to the control section in the post-processing apparatus corresponding to the selected cassette in forming images. Further, the "thickness information of the sheet" is input from the control panel 64 by an operator, or an ultrasonic sensor is disposed in the sheet discharge P3, and detects the thickness of a sheet passed through the path. As the configuration, various methods are already known, and descriptions thereof are omitted.

[Height Position Adjustment of the Stack Tray]

As described above, to adjust the position of the stack tray 29 to the first and second height positions Th1, Th2, the home position of the sheet surface detecting means 47 is set, for example, at the first height position Th1. Then, for the second height position Th2, the lift motor ML is controlled to position the means 47 in the home position that is the first height position, and then, is rotated by a predetermined amount to lift the stack tray 29 by a predetermined amount. At this point, the first sensor 49*a* and second sensor 49*b* of the sheet surface detecting means 47 described previously are both "ON", and the tray is lowered in the control as described previously, but the control sequence of lowering the tray is halted (non-operation state). The detailed control will be described later.

[Description of the Control Configuration]

Figure 9:
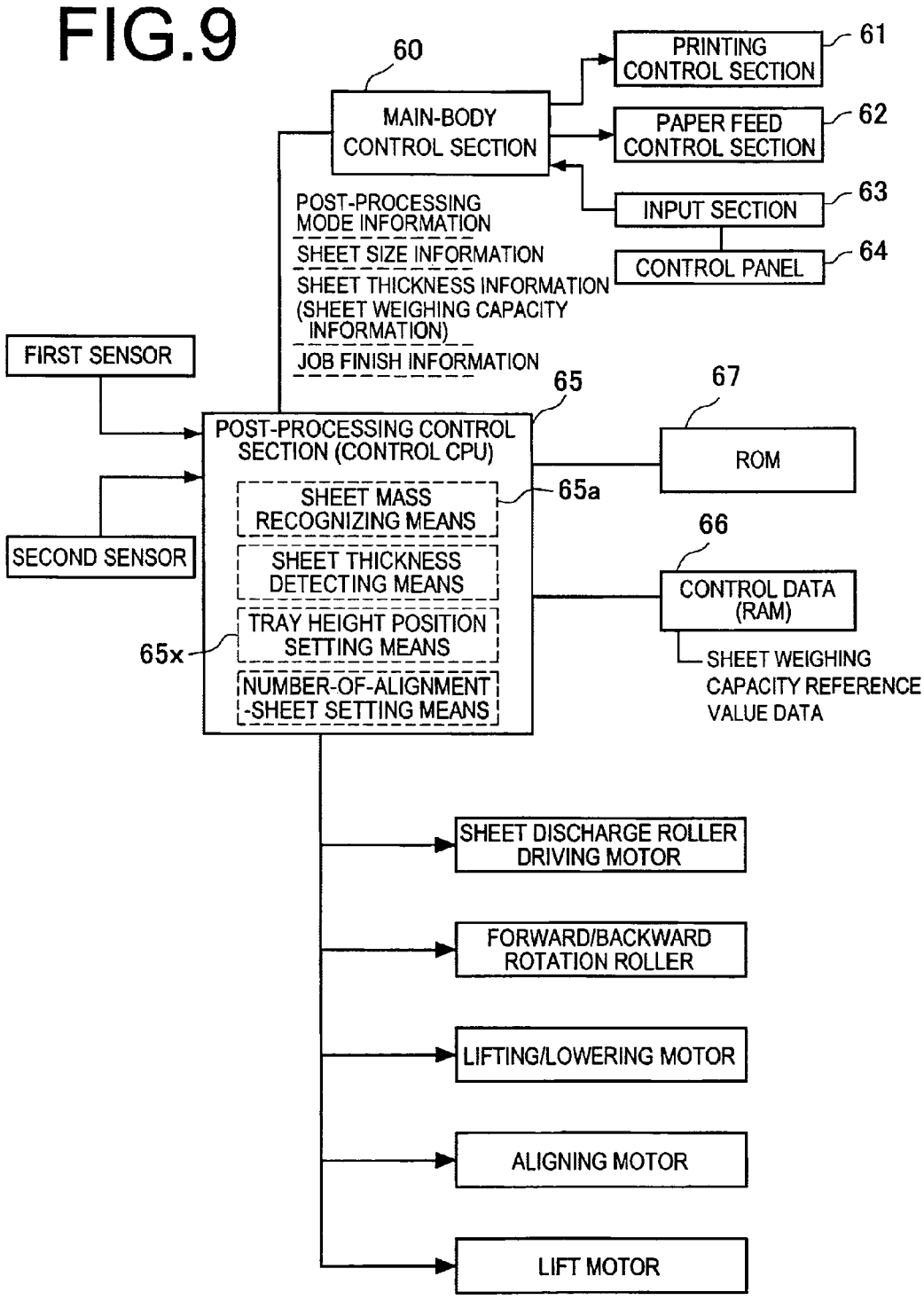
FIG. 9 is a block diagram illustrating a control configuration in the image formation system in FIG. 1.

The control configuration of the image formation system as described above will be described according to the block diagram of FIG. 9. The image formation system as shown in FIG. 1 is provided with the control section (hereinafter, referred to as a "main-body control section") 60 of the image formation apparatus A and the control section (hereinafter, referred to as a "post-processing control section") 65 of the sheet post-processing apparatus B. The main-body control section 60 is provided with a printing control section 61, paper feed control section 62 and input section 63, and the input section is provided with the control panel 64.

Then, settings of an "image formation mode" and a "post-processing mode" are made from the input section (control panel) 63. Set as the image formation mode are mode settings such as color/monochrome printing and two-sided/one-sided printing, and image formation conditions such as the sheet size, sheet quality, number-of-copy to print out and scaling printing. Further, set as the "post-printing mode" are, for example, a "print-out mode", "stapling finish mode", "bookbinding finish mode" and the like.

Further, the main-body control section 60 transfers data of the post-processing finish mode, the number of sheets, number-of-copy information, stitching mode (a single stitching or one or more stitching) information, sheet thickness information of sheets to form images, etc. to the post-processing control section 65. Concurrently therewith, the main-body control section 60 transfers a job finish signal to the post-processing control section 65 whenever image formation is finished.

The above-mentioned post-processing mode will be described. The above-mentioned "print-out mode" is to store a sheet from the sheet discharge outlet 24 on the stack tray 29 without performing the post-processing. In this case, the sheet is not collated and collected in the processing tray 28, and is directly carried out to the stack tray 29 from the sheet discharge outlet 24. The above-mentioned "stapling finish mode" is to collect and collate sheets from the sheet discharge outlet 24 on the processing tray 28, perform stitching finish on the bunch of sheets by the post-processing means 37, and then, store the sheets on the stack tray 29. In this case, in principle, as sheets to form images, sheets with the same thickness and same size are designated by an operator.

The above-mentioned "bookbinding finish mode" is to collate and collect sheets with image formed in the image formation apparatus A on the processing tray 28, finally form an image on a front cover sheet in the image formation apparatus A to place on the sheets on the processing tray, staple, and then store on the stack tray 29. In this case, the front cover sheet is designated (selected or input) by an operation as the "sheet thickness information" or "sheet basis weight information" corresponding to the thick sheet prepared in the paper cassette.

[Post-Processing Control Section]

The post-processing control section 65 is comprised of the control CPU 65 (control means; the same in the following) for operating the sheet post-processing apparatus B corresponding to the designated post-processing mode. The control section is provided with ROM 67 for storing an operation program and RAM 66 for storing control data.

[Lifting/Lowering Control of the Sheet Discharge Rotating Body]

The invention is characterized by configuring the timing of starting the lowering operation to be adjustable to be advanced or delayed corresponding to the "image formation conditions" in moving and lowering the sheet discharge rotating body (forward/backward rotation roller) 35 as previously described to the operation position Fp from the withdrawal position Wp. Therefore, the control means (control CPU; the same in the following) 65 controls the lifting/lowering motor MS and forward/backward rotation roller MR as described previously in the following manner based on the operation program stored in the ROM 67 and the control data stored in the RAM 66.

The above-mentioned operation program is to determine whether or not the bracket 34 is positioned in the withdrawal position Wp from a signal of the position sensor 34S in initializing at the time of starting the apparatus. Then, the program is configured to execute the operation of starting the lifting/lowering motor MS upward when the sensor signal is OFF, and positioning the bracket 34 in the withdrawal position Wp. Then, the operation program is configured to drive the sheet discharge rollers 25 to rotate, and concurrently therewith, drive the friction rotating body 40*v* of the aligning means 40 to rate using a signal that the carry-in sensor S1 detects the sheet front end. Concurrently therewith, using a signal that the sheet discharge sensor S2 detects the sheet rear end, the program is to start a timer T, start the lifting/lowering motor MS downward using a time-up signal of the timer T, and swing the bracket 34 to lower the sheet discharge rotating body (forward/backward rotating body) 35 to the operation position Fp from the withdrawal position Wp. Before the sheet discharge rotating body (forward/backward rotation roller) 35 arrives at the operation position Fp, the forward/backward rotation motor MR is rotated in a counterclockwise direction in FIG. 2.

The control data stored in the above-mentioned RAM 66 is provided with a time table Tt, and in the time table Tt is set timer time of the timer T. As the timer time set in the timer table Tt, stored is "timer time Tt1 in one-sided printing", "timer time Tt2 in two-sided printing", "timer time Tt3 in monochrome printing", "timer time Tt4 in color printing", "timer time Tt5 in thick-sheet printing" and "timer time Tt6 in thin-sheet printing".

Concurrently therewith, in the control data is stored data of the basis weight (mass) when the sheet is thick or thin. The timer time is set at Tt1<Tt2, Tt3<Tt4, and Tt5<Tt6. This is because the lending point that the sheet rear end Se is passed through the sheet discharge sensor S2 and then lands on the processing tray 28 from the sheet discharge outlet 24 is a long-distance position Ly in one-sided printing, monochrome printing and thick sheets as shown in FIG. 7, as described later in FIG. 7. Meanwhile, the landing point is a short-distance Lx in two-sided printing, color printing and thin sheets. Therefore, each timer time Tt1 to Tt6 is set to agree the landing point of the sheet with the set distance Lx. Accordingly, when the sheet is halted at this timer time, any sheet is halted in the set distance Lx.

In addition, the above-mentioned timer time Tt is set as described below, for example, corresponding to apparatus specifications or the like. First, the timer time is configured to vary corresponding to whether the printing mode is one-sided printing or two-sided printing. In this case, irrespective of monochrome or color printing and thick or thin sheets, the timer time is set at constant. Second, the timer time is configured to vary corresponding to whether the printing mode is monochrome printing or color printing. In this case, irrespective of one-sided or two-sided printing and thick or thin sheets, the timer time is set at constant Third, the timer time is configured to vary corresponding to whether the printing sheet is a thick sheet or thin sheet. In this case, irrespective of one-sided or two-sided printing and monochrome or color printing, the timer time is set at constant.

Fourth, the timer time Tt is set by combining each of the above-mentioned conditions. For example, when the sheet is a thin sheet and subjected to monochrome one-sided printing, the timer time Tt is set at the average time [Tt=(Tt6+Tt3+Tt1)/3] of [Tt6], [Tt3] and [Tt1]. Similarly, when the sheet is a thick sheet and subjected to color two-sided printing, the timer time Tt is set at [Tt=(Tt5+Tt4+Tt2)/3]. Moreover, for the above-mentioned timer table, it is preferable to obtain landing points on the processing tray of sheets under each condition by experiments, and store these optimal values in the RAM 66.

[Operation Procedure of the Sheet Discharge Rotating Body]

Figure 10:
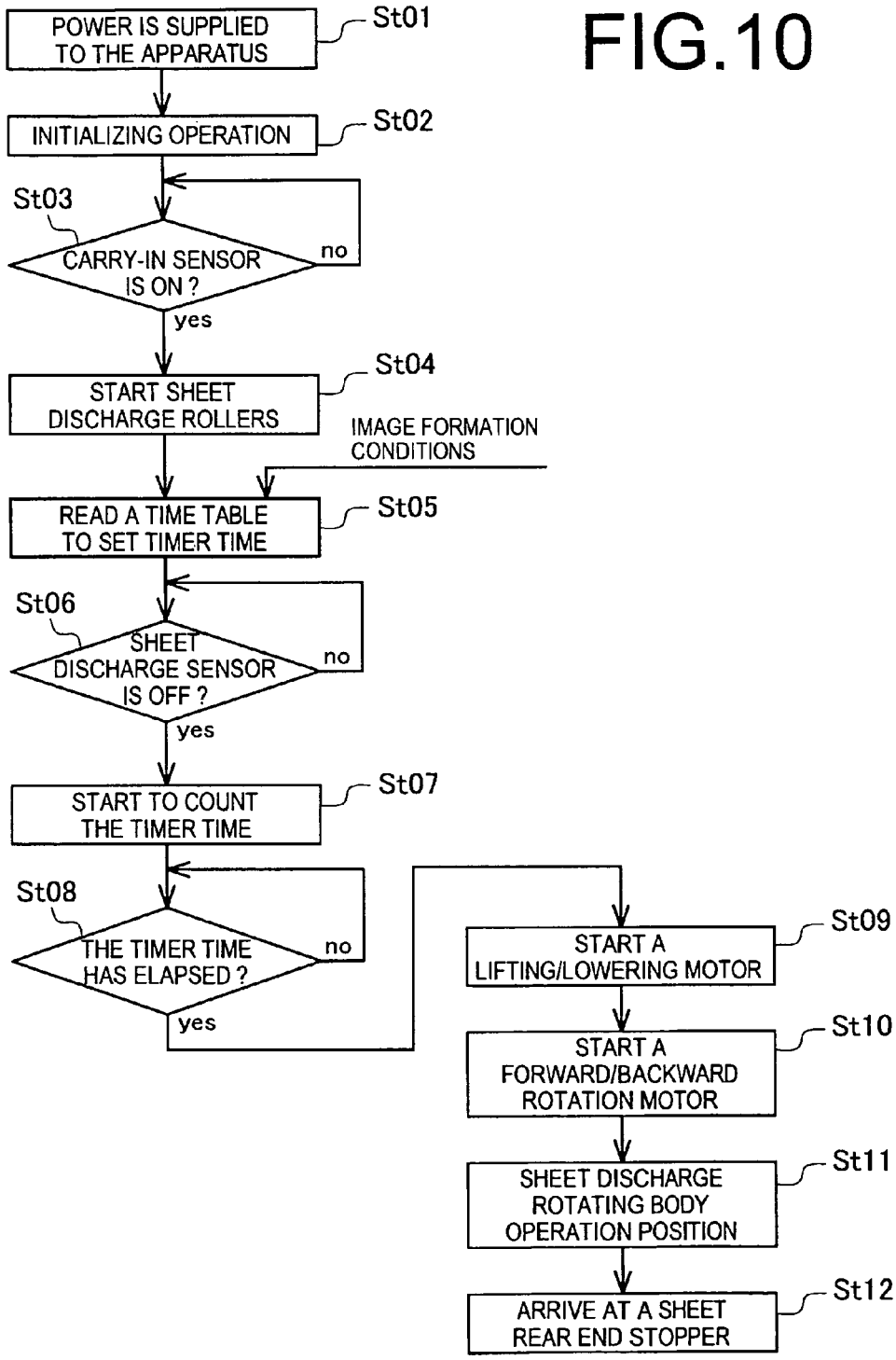
FIG. 10 is a flowchart illustrating an operation state in the control configuration in FIG. 9.
Figure 11A:
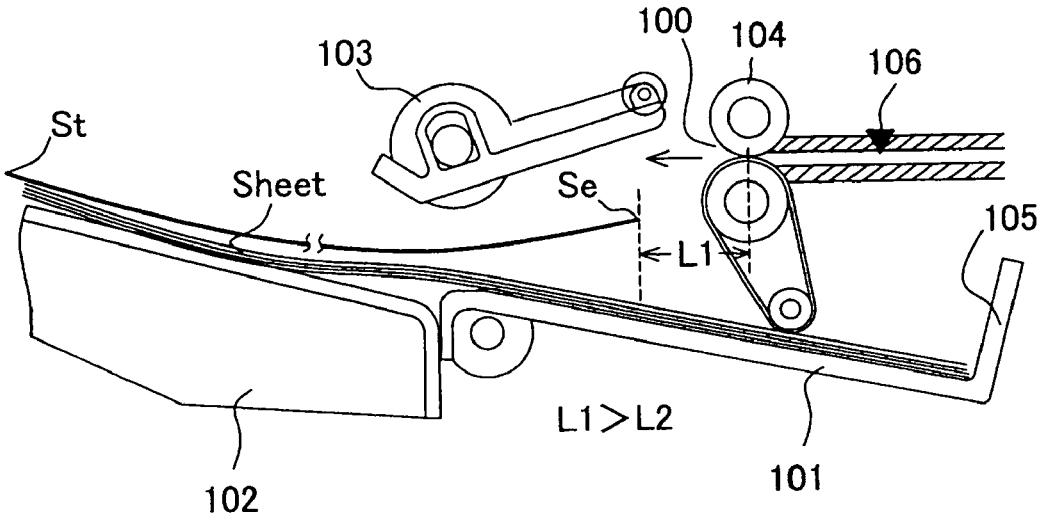
FIG. 11 shows sheet discharge states of a sheet in a conventional sheet discharge apparatus, where FIG. 11(*a*) shows a sheet discharge state of a thick sheet, and FIG. 11(*b*) shows a sheet discharge state of a thin sheet.
Figure 11B:
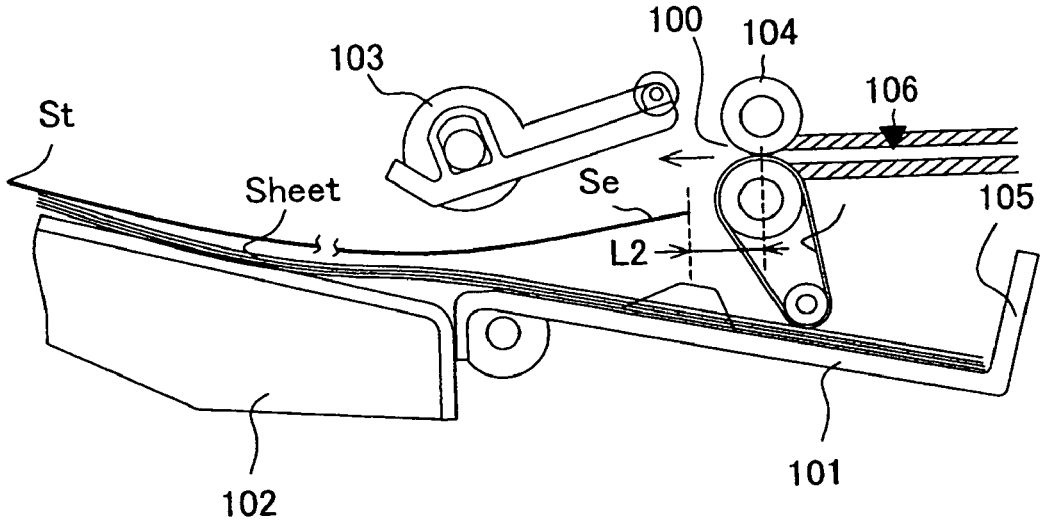

The action of the control means 65 configured as described above will be described according to the flowchart as shown in FIG. 10. When power is supplied to the apparatus (St01), both of the sheet discharge unit B and image formation apparatus A execute initializing operation (St02). In the initializing operation, the control means 65 positions the sheet discharge rotating body (forward/backward rotation roller) 35 in the withdrawal position Wp.

Next, the control means 65 detects that the front end of the sheet with an image formed in the image formation apparatus A reaches the carry-in sensor S1 (St03). Using a sheet front end detection signal from the carry-in sensor S1, the control means 65 drives the sheet discharge rollers 25 to rotate in the sheet discharge direction (St04). Concurrently therewith, when the post-processing mode is set at the print-out mode, stapling finish mode or bookbinding finish mode as described previously, the means 65 shifts the path switching flapper 26 to the state as shown in FIG. 3(*a*). By this means, the sheet is guided to the sheet discharge outlet 24. Meanwhile, when the mode is set at the interrupt mode, the sheet is guided to the eject path P4 by the path switching flapper 26. By the rotation of the sheet discharge rollers 25 as described above, the friction rotating body 40*v* is also started to rotate in the sheet discharge direction (St05).

When the sheet arrives at the sheet discharge rollers 25, the sheet is carried out gradually onto the processing tray 28 from the front end by the rotation. At this point, the control means 65 starts the timer T by a detection signal that the sheet discharge sensor S2 detects the sheet rear end. The timer T counts the CPU internal clock, or counts the externally provided clock (St06). Before starting the timer, the control means 65 reads the timer time from the RAM 66, and sets timer time Tt corresponding to the image formation conditions as described previously transferred from the image formation apparatus A (St05).

Next, the control means 65 determines whether or not the sheet discharge sensor S2 is OFF and the sheet rear end is passed through the sensor (St06). Then, by a sensor signal that the sheet rear end is passed through the sensor position, the means 65 starts the timer to count the time (St07). Then, in a stage that the set timer time Tt has elapsed (St08), the means 65 drives and rotates the lifting/lowering motor MS as described previously in the downward direction. Then, the sheet discharge rotating body 35 supported by the bracket 34 starts to lower to the operation position Fp from the withdrawal position Wp. Immediately after (or concurrently with) a lapse of the timer time Tt, the control means 65 drives the forward/backward rotation motor MR to rotate (St10). The rotation direction is set at the opposite direction to the sheet discharge direction to transfer the sheet to the rear end regulation stopper 30 side.

Figure 8:
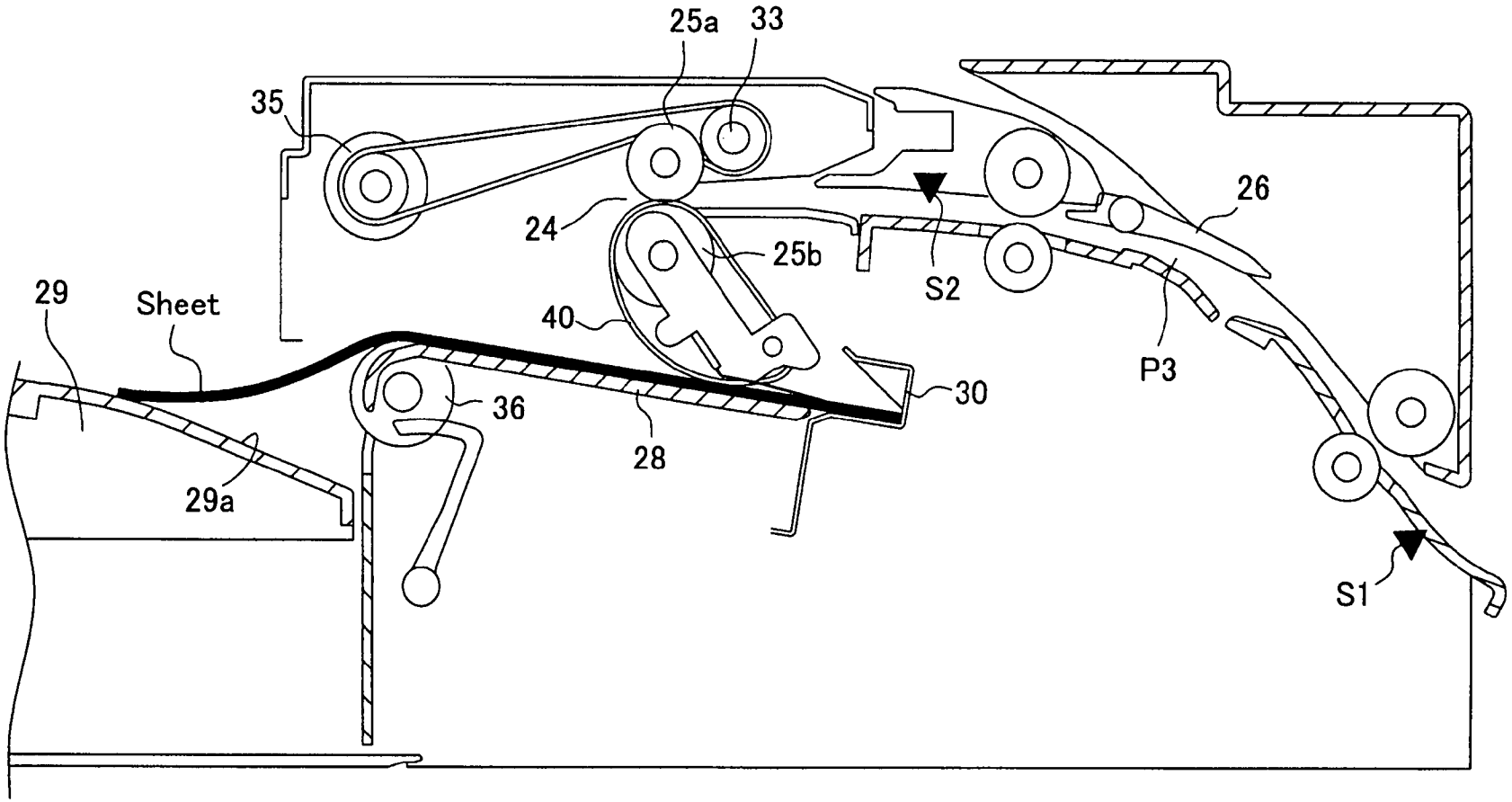
FIG. 8 is an operation explanatory view of a state where the sheet is transferred to a rear end regulation stopper by the sheet discharge rotating body in the sheet discharge unit in FIG. 2.

By such control, as shown in FIG. 7, the rear end of the sheet passed through the sheet discharge outlet 24 arrives at the landing point Lx shown in the figure. At this point, the sheet discharge rotating body 35 shifts to the operation position Fp engaging in the sheet from the withdrawal position Wp. Then, by the rotation of the sheet discharge rotating body 35, the sheet is transferred toward the rear end regulation stopper 30 (St12). At this point, also the aligning means 40 feeds the sheet in the same direction and assists the movement. Then, the sheet rear end is struck against the rear end regulation stopper 30 and aligned as shown in FIG. 8.

In addition, in the invention, with respect to the operation timing of shifting the sheet discharge rotating body 35 as described previously from the waiting position to the operation position engaging in the sheet on the tray, the Embodiment shown in the figure shows the case that the operation starting timing of starting to shift the sheet discharge rotating body 35 to the operation position from the waiting position is advanced or delayed corresponding to the basis weight of the sheet. Moreover, it may be configured that the velocity such that the sheet discharge rotating body 35 shifts to the operation position from the waiting position is set in two, high and low, stages. In this case, when the basis weight of the sheet is larger than a predetermined value, the velocity is set at a high velocity, while being set at a low velocity, when the basis weight of the sheet is smaller than the predetermined value. Further, in the invention, shown is the driving mechanism that the body lowers to the operation position Wp from the withdrawal position Wp at the same velocity as that of the driving rotation speed of the swing rotary shaft 33 coupled to the lifting/lowering motor MS as described previously. Alternately, the sheet discharge rotating body 35 may be configured to drop and shift to the operation position Fp from the withdrawal position Wp under its own weight. In this case, the lifting/lowering motor MS and the bracket 34 are configured to separate by clutch means.

Similarly, in the invention, the case is shown where the sheet from the sheet discharge outlet is bridge-supported at the front end side on the stack tray 29 and at the rear end on the processing tray 28. Alternately, it is naturally available that the processing tray 28 is configured in the long size adapted to the sheet size so as to support the entire sheet from the sheet discharge outlet on the processing tray 28.

[Post-Processing Control Section]

The post-processing control section 65 is comprised of the control CPU 65 (control means; the same in the following) for operating the post-processing apparatus B according to the designated post-processing mode. The control section is provided with the ROM 67 for storing an operation program and the RAM 66 for storing control data.

The above-mentioned operation program is to determine whether or not the stack tray 29 is positioned in the home position (first height position Th1 as described previously) using a signal from the sheet surface detecting means 47 in initializing when the apparatus is started. Then, the section 65 is configured to execute the initializing operation for positioning the stack tray 29 in the home position using the "ON"/"OFF" information of the first and second sensors 49*a*, 49*b* as described previously.

The above-mentioned operation program is to start the timer T using a signal that the sheet discharge sensor S2 detects the sheet rear end, start the lifting/lowering motor MS in the downward direction using a time-up signal of the timer T, swing the bracket 34, and lower the forward/backward rotation roller 35 from the withdrawal position Wp to the operation position Fp. The program is configured to rotate the forward/backward rotation motor MR in the counterclockwise direction in FIG. 2 before the forward/backward rotation roller 35 arrives at the operation position Fp.

Further, the above-mentioned post-processing control section 65 is provided with a "sheet basis weight recognizing means" or "sheet thickness detecting means". For the "sheet basis weight recognizing means", it is configured that the control section 60 in the image formation apparatus A transfers the basis weight information input from the control panel 64 by an operator corresponding to the basis weight of sheets prepared in the paper cassettes 11*a* to 11*c* to the post-processing control section 65. Then, the post-processing control section (control CPU) 65 is provided with a sheet basis weight recognizing means 65*a* for recognizing the basis weight of the sheet fed to the sheet discharge path P3 based on the "basis weight information" transferred from the image formation apparatus A.

Meanwhile, for the above-mentioned "sheet thickness detecting means", as described previously, a thickness detecting sensor such as an ultrasonic sensor is provided in the sheet discharge path P3, and the control CPU 65 is provided with a means for determining the thickness of the sheet fed to the sheet discharge path P3 based on the detection information from the sensor.

Then, the post-processing control section 65 is provided with a stack tray height position setting means 65*x*. The means is configured to compare the reference value stored in the RAM 66 with the sheet basis weight or the sheet thickness, and set the position at the first height position Th1 when the value is less than the reference value, while setting the position at the second height position Th2 when the value is the reference value or more. Similarly, the means may be configured to compare the reference value stored in the RAM 66 with the sheet basis weight or the sheet thickness, and set the position at the first height position Th1 when the value is the reference value or less, while setting the position at the second height position Th2 when the value exceeds the reference value.

[Sheet Discharge Operation Flow]

Figure 14:
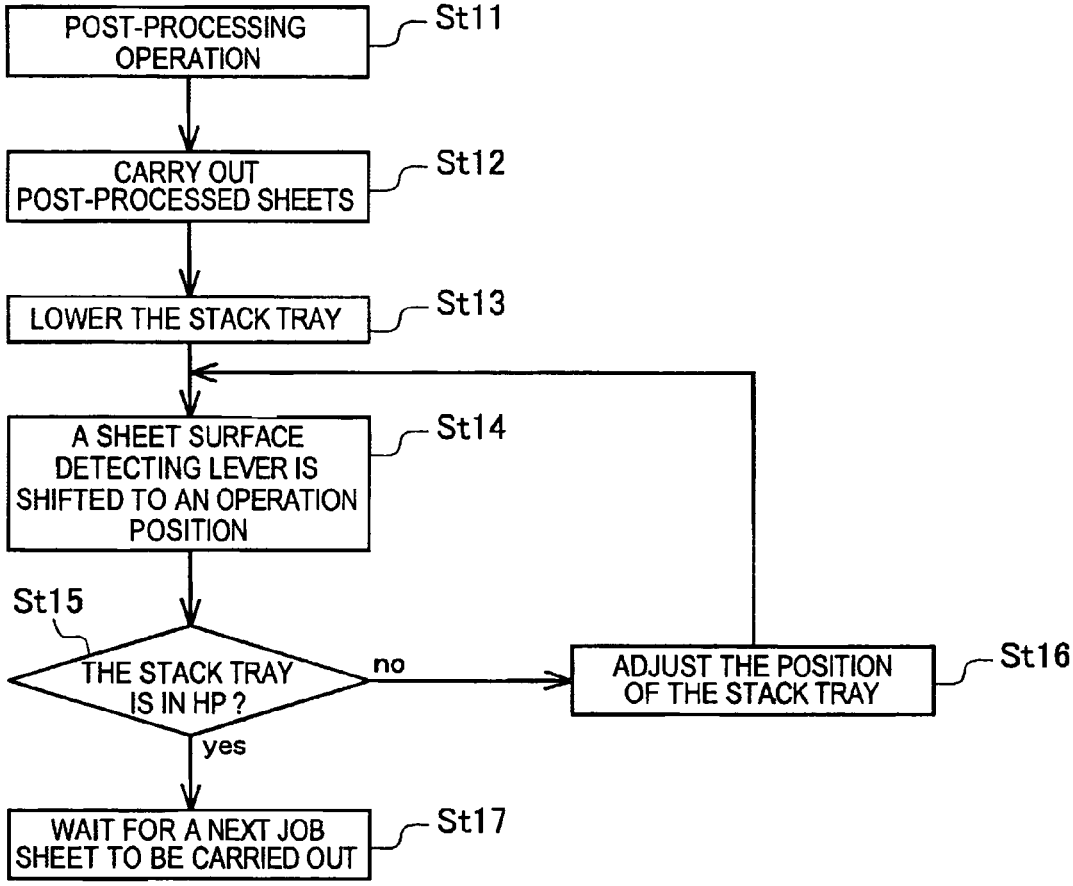
FIG. 14 is a flowchart illustrating a post-processing operation state in the control configuration in FIG. 9.

The action of the control section 65 configured as described above will be described according to the flowcharts as shown in FIGS. 13 and 14. When the power is supplied to the apparatus (St01), the sheet discharge unit B executes the initializing operation together with the image formation apparatus A (St02). In the initializing operation, the control means 65 positions the stack tray 29 in the home position.

Next, the control means 65 detects that the front end of the sheet with an image formed in the image formation apparatus A reaches the carry-in sensor S1 (St03). Using a sheet front end detection signal from the carry-in sensor S1, the control means 65 drives the sheet discharge rollers 25 to rotate in the sheet discharge direction (St04). Concurrently therewith, when the post-processing mode is set at the print-outmode, Stapling finish mode or bookbinding finish mode as described previously, the means 65 shifts the path switching flapper 26 to the state as shown in FIG. 3(*a*). By this means, the sheet is guided to the sheet discharge outlet 24. Meanwhile, when the mode is set at the interrupt mode, the sheet is guided to the eject path P4 by the path switching flapper 26.

Then, the control CPU 65 compares the thickness (basis weight) of the sheet with the reference value stored in the RAM 66 based on the "thickness information" or "basis weight information" of the sheet transferred from the image formation apparatus A (St05). Using the comparison result, the section 65 sets the height position of the stack tray 29 at the second height position Th2 when the value is the reference value or more, while setting the height position at the first height position Th1 when the value is less than the reference value. Similarly, using the comparison result as described above, the section 65 may be configured to set the height position of the stack tray 29 at the second height position Th2 when the value exceeds the reference value, while setting the height position at the first height position Th1 when the value is the reference value or less. In this case, for the second height position Th2, as described previously, the control CPU 65 moves the stack tray 29 positioned in the home position to the predetermined height position by rotation of the lift motor ML. The rotation amount of the lift motor ML at this point is stored in the RAM 66.

When the sheet arrives at the sheet discharge rollers 25, the sheet is carried out gradually onto the processing tray 28 from the front end by the rotation. At this point, the control means 65 starts the timer T by a detection signal (St06) that the sheet discharge sensor S2 detects the sheet rear end. The timer T counts the CPU internal clock, or counts the externally provided clock (St07).

Then, in a stage that the previously set timer time has elapsed (St08), the means 65 executes the sheet discharge operation (St09). The sheet discharge operation is to shift the forward/backward rotation roller 35 to the operation position Fp from the waiting position Wp, and concurrently, rotate the forward/backward rotation roller 35 in the sheet-discharge opposite direction. Then, the sheet that is carried out onto the processing tray from the sheet discharge outlet 24 is switch-back transported in the opposite direction to the sheet discharge direction, and the sheet rear end arrives at the rear end regulation stopper 30. After the predicted time the sheet rear end reaches the stopper, the means 65 halts the forward/backward rotation roller 35 to return to the withdrawal position Wp.

Then, the control CPU 65 determines whether or not the image formation apparatus A issues a job finish signal (St10). When the job is not finished in the determination, the control CPU 65 returns to step St03, and similarly carries out a subsequent sheet onto the processing tray. Meanwhile, when the job is finished, the control CPU 65 causes the post-processing means 37 to execute the post-processing operation (St11).

Figure 2A:
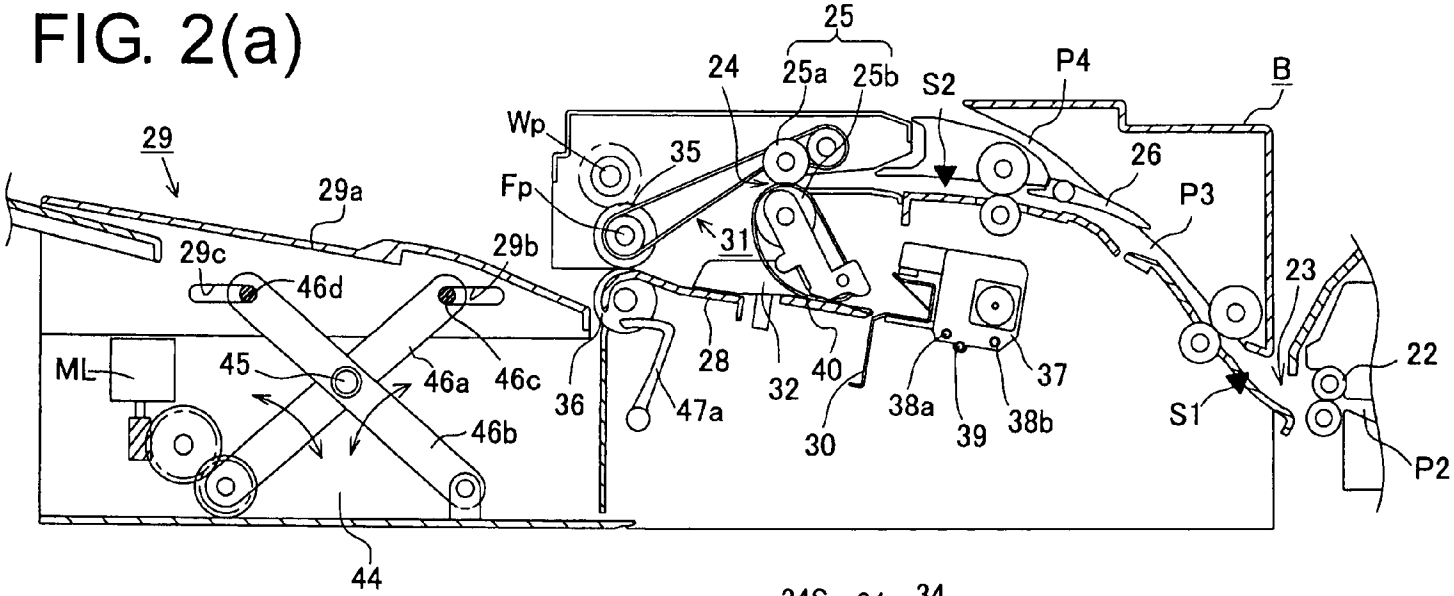
FIG. 2 contains explanatory views of a sheet discharge unit (sheet post-processing apparatus) in the system in FIG. 1, where FIG. 2(*a*) is an explanatory view of the entire configuration, and FIG. 2(*b*) is an explanatory view of a lifting/lowering mechanism of a sheet discharge rotating body.
Figure 2B:
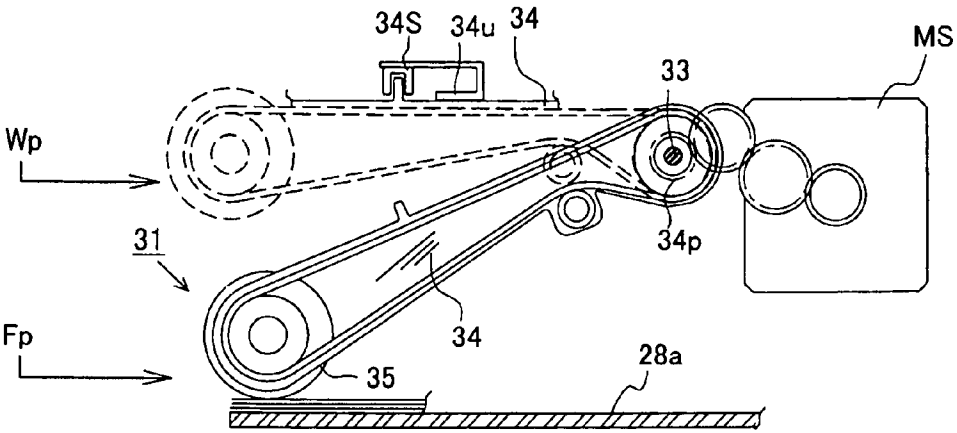

After the post-processing operation, the control CPU 65 shifts the forward/backward rotation roller 35 to the operation position Fp from the withdrawal position Wp, and concurrently, rotates the forward/backward rotation roller 35 in the counterclockwise direction in FIG. 2. Then, the sheets (bunch) on the processing tray 28 are carried out to the stack tray 29 on the downstream side (St12). In addition, in this case, it is also possible to shift the stack tray 29 to a height position different from the first and second height positions Th1, Th2 as described previously, and the tray height position is preferably set at an optimal position to carry out the sheets on the processing tray 28.

After finishing the above-mentioned sheet discharge operation, the control CPU 65 lowers the stack tray 29 by a predetermined amount (St13). This is because the height position of the uppermost sheet on the stack tray 29 is higher than the home position by the sheets being carried out of the processing tray 28, and therefore, the stack tray 29 needs to be lowered by a beforehand set down amount.

Then, the control CPU 65 moves the sheet surface detecting means 47 to the operation position to detect a sheet surface level (St14). When the stack tray 29 is in a position except the home position in the sheet surface level detection, the control CPU 65 moves the tray height upward or downward using state signals of the first and second sensors 49*a*, 49*b* (St16). The control CPU 65 sets the height position of the stack tray 29 at the home position by such tray height adjustments, and prepares for sheet carrying out in the next job.

[Post-Processing Control Section]

The post-processing control section 65 is comprised of the control CPU 65 (control means; the same in the following) for operating the post-processing apparatus B according to the designated post-processing mode. The control section is provided with the ROM 67 for storing an operation program and the RAM 66 for storing control data.

The above-mentioned operation program is configured to position the right and left aligning plates 32R, 32L in the home positions Hp in initializing when the apparatus is started. This positioning is made by rotating and controlling the aligning motors Mz1, Mz2 using a signal from a position sensor not shown. Concurrently therewith, the operation program is configured to position the stack tray 29 and sheet transfer means 31 in respective initial positions.

The above-mentioned operation program is configured to shift the positions of the right and left aligning plates 32R, 32L to the waiting positions Wp from the home positions Hp based on the size information transferred from the control section in the image formation apparatus A, using a signal that the carry-in sensor S1 detects the sheet front end. The waiting positions Wp are set corresponding to the size of the sheet, and stored in the RAM 66 as the data. Concurrently therewith, the operation program is configured to start the timer T using a signal that the sheet discharge sensor S2 detects the sheet rear end, and drive and rotate the aligning motors Mz1, Mz2 by a predetermined amount using a time-up signal of the timer T. The rotation amount (or driving time) is beforehand stored in the RAM 66 as the data.

Further, the above-mentioned post-processing control section 65 is provided with a sheet property recognizing means as the "sheet basis weight recognizing means" or "sheet size recognizing means". The "sheet basis weight recognizing means" is configured to acquire the basis weight information input from the control panel 64 by an operator corresponding to the basis weight of sheets prepared in the paper cassette 11 and determine the basis weight of the sheet. Meanwhile, the "sheet size recognizing means" is configured to similarly acquire the size information of sheets prepared in the paper cassettes 11*a* to 11*c* in the control section 60 in the image formation apparatus, and determine the size of the sheets.

Then, the post-processing control section 65 is provided with a number-of-alignment-sheet setting means, and this means is configured to compare the reference value stored in the RAM 66 with the sheet weighting capacity or the sheet size, and set the number of alignment sheets at "b" when the value is a reference value or less, while setting the number at "a" when the value is more than the reference value. Further, the numbers of alignment sheets are beforehand set (a<b) and stored in the RAM 66 as the data.

[Sheet Discharge Operation Flow]

Figure 16:
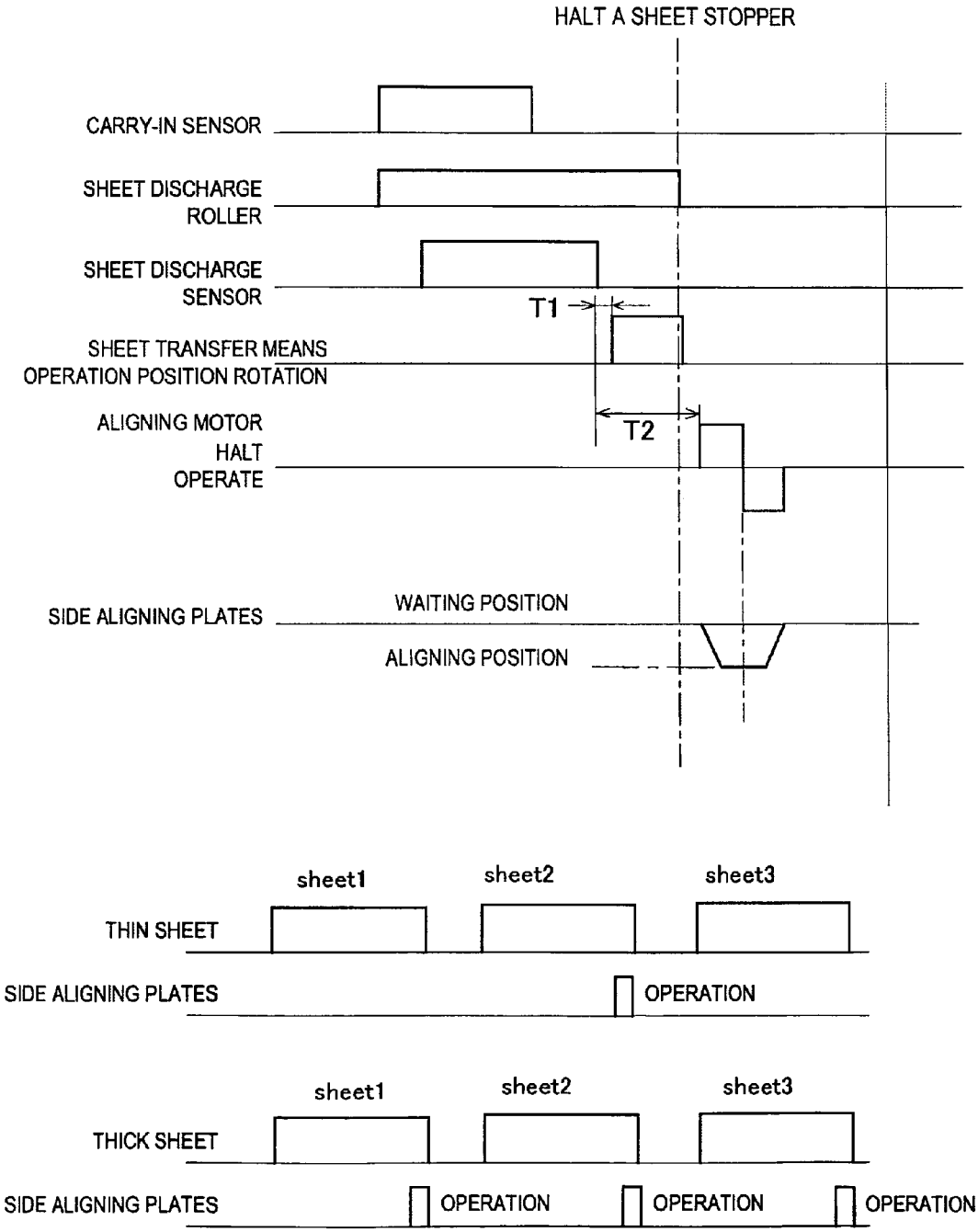
FIG. 16 is a timing chart.
Figure 17:
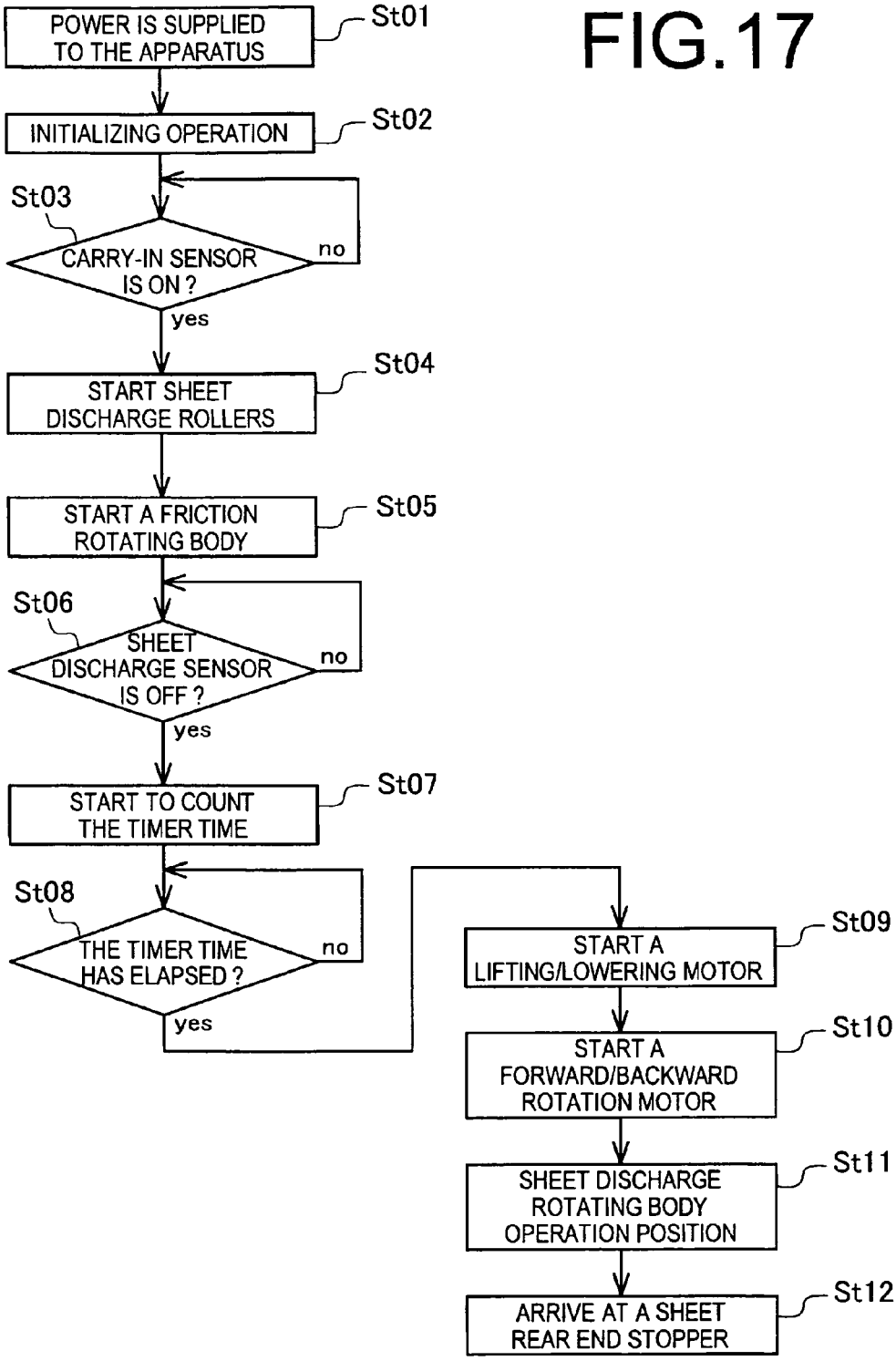
FIG. 17 is still another flowchart illustrating the operation state in the control configuration in FIG. 9.

The action of the control means 65 configured as described above will be described according to the flowchart as shown in FIG. 15 and the timing chart as shown in FIG. 16. When the power is supplied to the apparatus (St01), the sheet discharge unit B executes the initializing operation together with the image formation apparatus A (St02). In the initializing operation, the control means 65 positions the side aligning means 32 in the home position. Next, the control means 65 detects that the front end of the sheet with an image formed in the image formation apparatus A reaches the carry-in sensor S1 (St03). Using a sheet front end detection signal from the carry-in sensor S1, the control means 65 drives the sheet discharge rollers 25 to rotate in the sheet discharge direction (St04).

Concurrently therewith, when the post-processing mode is set at the print-out mode, stapling finish mode or bookbinding finish mode as described previously, the means 65 shifts the path switching flapper 26 to the state as shown in FIG. 3. By this means, the sheet is guided to the sheet discharge outlet 24. Meanwhile, when the mode is set at the interrupt mode, the sheet is guided to the eject path P4 by the path switching flapper 26.

Next, the control CPU 65 compares the basis weight of the sheet or the size of the sheet with the reference value stored in the RAM 66 based on the "size information" or "basis weight information" of the sheet transferred from the image formation apparatus A (St05). Using the comparison result, the control CPU 65 sets the number of alignment sheets at a when the value is more than the reference value, while setting the number of alignment sheets at b when the value is not more than the reference value. The control CPU 65 reads the data of "a" and "b" (a<b) from the RAM 66.

Then, when the sheet arrives at the sheet discharge rollers 25, the sheet is carried out gradually onto the processing tray 28 from the front end by the rotation. At this point, the control means 65 starts the timer T by a detection signal (St06) that the sheet discharge sensor S2 detects the sheet rear end. The timer time T1 is obtained by counting the CPU internal clock, or counting the externally provided clock (St07).

Next, in a stage that the previously set timer time T1 has elapsed (St08), the means 65 executes the sheet discharge operation (St09). The sheet discharge operation is to shift the forward/backward rotation roller 35 to the operation position from the waiting position, and concurrently, rotate the roller 35 in the sheet-discharge opposite direction. Then, the sheet that is carried out onto the processing tray from the sheet discharge outlet 24 is switch-back transported in the opposite direction to the sheet discharge direction, and the sheet rear end reaches the rear end regulation stopper 30.

Then, the control means 65 determines whether or not the timer time T2 (predicted time the sheet rear end arrives at the stopper) has elapsed in the timer previously started by an OFF signal of the sheet discharge sensor (St10). Then, after a lapse of the timer time, the control means 65 determines whether or not the number of discharged sheets reaches the number of alignment sheets (a sheets or b sheets) (St11). For example, as the number of discharged sheets, it is configured to count a signal of the sheet discharge sensor S2. Then, the control means 65 executes the aligning operation when the number of discharged sheets reaches the set number of alignment sheets (St012), while shifting to step St03 as described above for waiting a sheet to be carried in from the sheet discharge outlet when the number of discharged sheets does not reach the number of alignment sheets.

In addition, in the aforementioned descriptions of the operation flow, the case is described that the number of alignment sheets by the aligning means 32 is set from the basis weight information of the sheet, and such operation is the same as in the case of setting the number at "a" when the size of the sheet is smaller than a beforehand set reference size, while setting the number at "b" when the size of the sheet is larger than the reference size (a<b). Then, the numbers of sheets are set, for example, at a=1 and b=2, and are stored in the RAM 66 as the data.

Further, with respect to alignment control corresponding to the basis weight of the sheet, width-direction size, and discharge-direction size as described above, it is controlled that the side aligning means 32 concurrently aligns a plurality of sheets in the width after the predetermined number "b" of sheets (for example, two sheets; b>2) is carried onto the processing tray 28 when the basis weight of the sheet is a beforehand set reference value or less, the width size of the sheet is a beforehand set reference value or more, or the size of the sheet in the sheet discharge direction is a beforehand set reference value or more, and that the side aligning means 32 aligns the sheet in the width in a stage that the predetermined number "a" of sheets (for example, one sheet; a<b) is carried onto the processing tray 28 when the basis weight of the sheet exceeds the beforehand set reference value, the width size of the sheet is less than the beforehand set reference value, or the size of the sheet in the sheet discharge direction is less than the beforehand set reference value.

However, the subject matter of the sheet post-processing apparatus is not limited to such control, and for example, control may be made so that the side aligning means 32 concurrently aligns a plurality of sheets in the width after the predetermined number "b" of sheets (for example, two sheets; b>2) is carried onto the processing tray 28 when the basis weight of the sheet is less than a beforehand set reference value, the width size of the sheet exceeds a beforehand set reference value, or the size of the sheet in the sheet discharge direction exceeds a beforehand set reference value, and that the side aligning means 32 aligns the sheet in the width in a stage that the predetermined number "a" of sheets (for example, one sheet; a<b) is carried onto the processing tray 28 when the basis weight of the sheet is the beforehand set reference value or more, the width size of the sheet is the beforehand set reference value or less, or the size of the sheet in the sheet discharge direction is the beforehand set reference value or less.

In addition, this application claims priority from Japanese Patent Application No. 2009-164187, Japanese Patent Application No. 2009-164188, Japanese Patent Application No. 2009-164189 and Japanese Patent Application No. 2009-164190 incorporated herein by reference.

What is claimed is:

1. A sheet post-processing apparatus for collating and collecting sheets fed from an image formation apparatus to performing post-processing, comprising:

a sheet discharge outlet;

tray means for loading and collecting a sheet fed from the sheet discharge outlet;

sheet end regulation means provided on the tray means to regulate an end edge of the sheet;

a sheet discharge rotating body for transferring the sheet that is carried out onto the tray means toward the sheet end regulation means;

lifting/lowering support means for supporting the sheet discharge rotating body to able to move up and down between an operation position coming into contact with the sheet on the tray means and a withdrawal position separated from the sheet;

lifting/lowering driving means for driving the lifting/lowering support means; and lifting/lowering control means for controlling the lifting/lowering driving means, wherein the lifting/lowering control means is configured is to be able to adjust operation timing of shifting the sheet discharge rotating body to the operation position from the withdrawal position corresponding to image formation conditions of the sheet.

2. The sheet post-processing apparatus according to claim 1, wherein the lifting/lowering control means is configured to advance the operation timing of shifting the sheet discharge rotating body to the operation position from the withdrawal position when basis weight of the sheet is large, while delaying the operation timing when the basis weight of the sheet is small.

3. The sheet post-processing apparatus according to claim 1, wherein the lifting/lowering control means is configured to advance the operation timing of shifting the sheet discharge rotating body to the operation position from the withdrawal position when an image is formed on one side of the sheet, while delaying the operation timing when images are formed on both sides of the sheet.

4. The sheet post-processing apparatus according to claim 1, wherein the tray means is configured to bridge-support the sheet from the sheet discharge outlet with a stack tray disposed on the downstream side, and the sheet discharge rotating body is configured to be able to move up and down to move above the tray means so as to carry out the sheet to the stack tray after transferring the sheet from the sheet discharge outlet toward the sheet end regulation means.

5. The sheet post-processing apparatus according to claim 1, wherein in the tray means is disposed post-processing means for stitching a sheet end positioned by the sheet end regulation means, and the sheet discharge rotating body is comprised of a forward/backward rotation roller for transferring the sheet from the sheet discharge outlet toward the sheet end regulation means, while carrying out a bunch of sheets subjected to post-processing to the stack tray disposed on the downstream side.

6. The sheet post-processing apparatus according to claim 1, wherein a sheet sensor to detect passage of the sheet is disposed in the sheet discharge outlet or on the upstream side of the outlet, and the lifting/lowering control means is configured to set the operation timing of shifting the sheet discharge rotating body to the operation position from the withdrawal position based on basis weight information of the sheet or printing mode information with reference to a rear end detection signal from the sheet sensor.

7. The sheet post-processing apparatus according to claim 1, further comprising:

a stack tray disposed on the downstream side of the tray means to store a sheet from the tray means;

tray lifting/lowering means for lifting and lowering the stack tray corresponding to a load amount of sheets; and control means for controlling the tray lifting/lowering means, wherein the tray means and the stack tray are configured to support the sheet fed from the sheet discharge outlet by the stack tray supporting a front end portion of the sheet and the tray means supporting a rear end portion of the sheet, and the control means sets a height position of the stack tray at a different position corresponding to basis weight of the sheet in transferring the sheet toward the sheet end regulation means with the sheet discharge rotating body.

8. The sheet post-processing apparatus according to claim 7, wherein in transferring the sheet toward the sheet end regulation means with the sheet discharge rotating body, the control means sets the height position of the stack tray at a high position when the basis weight of the sheet is a predetermined value or more, while setting the height position of the stack tray at a low position when the basis weight of the sheet is less than the predetermined value.

9. The sheet post-processing apparatus according to claim 7, wherein in transferring the sheet toward the sheet end regulation means with the sheet discharge rotating body, the control means sets the height position of the stack tray at a high position when the basis weight of the sheet exceeds a predetermined value, while setting the height position of the stack tray at a low position when the basis weight of the sheet is the predetermined value or less.

10. The sheet post-processing apparatus according to claim 7, wherein the control means has sheet basis weight recognizing means for determining a weight per unit area of the sheet carried out of the sheet discharge outlet.

11. The sheet post-processing apparatus according to claim 7, wherein the sheet discharge rotating body is coupled to driving means capable of rotating forward and backward so as to carry out the sheet to the stack tray after transferring the sheet from the sheet discharge outlet toward the sheet end regulation means.

12. The sheet post-processing apparatus according to claim 7, wherein thickness detecting means for detecting a thickness of the sheet to be fed to the sheet discharge outlet is disposed on the upstream side of the sheet discharge outlet, and the control means controls the height position of the stack tray based on detection information from the thickness detecting means.

13. An image formation system comprising:

an image formation apparatus for forming images on sheets; and a sheet post-processing apparatus for collating and collecting the sheets from the image formation apparatus to perform post-processing, wherein the sheet post-processing apparatus has a configuration as described in claim 1.

14. A sheet post-processing apparatus comprising:

a sheet discharge outlet;

processing tray means disposed on the downstream side of the sheet discharge outlet to temporarily collect a sheet;

a stack tray disposed on the downstream side of the processing tray means to store the sheet from the processing tray means;

sheet end regulation means disposed on the processing tray means to regulate a rear end edge of the sheet;

a transport rotating body disposed on the processing tray means to transfer the sheet toward the sheet end regulation means;

tray lifting/lowering means for lifting and lowering the stack tray corresponding to a load amount of sheets; and control means for controlling the tray lifting/lowering means, wherein the processing tray means and the stack tray are configured to support the sheet fed from the sheet discharge outlet by the stack tray supporting a front end portion of the sheet and the processing tray means supporting a rear end portion of the sheet, and the control means sets a height position of the stack tray at a different position corresponding to basis weight of the sheet in transferring the sheet toward the sheet end regulation means with the transport rotating body.

15. The sheet post-processing apparatus according to claim 14, wherein in transferring the sheet toward the sheet end regulation means with the transport rotating body, the control means sets the height position of the stack tray at a high position when the basis weight of the sheet is a predetermined value or more, while setting the height position of the stack tray at a low position when the basis weight of the sheet is less than the predetermined value.

16. The sheet post-processing apparatus according to claim 14, wherein in transferring the sheet toward the sheet end regulation means with the transport rotating body, the control means sets the height position of the stack tray at a high position when the basis weight of the sheet exceeds a predetermined value, while setting the height position of the stack tray at a low position when the basis weight of the sheet is the predetermined value or less.

17. The sheet post-processing apparatus according to claim 14, wherein the control means has sheet basis weight recognizing means for determining a weight per unit area of the sheet carried out of the sheet discharge outlet.

18. The sheet post-processing apparatus according to claim 14, wherein the transport rotating body is coupled to driving means capable of rotating forward and backward so as to carry out the sheet to the stack tray after transferring the sheet from the sheet discharge outlet toward the sheet end regulation means.

19. The sheet post-processing apparatus according to claim 14, wherein thickness detecting means for detecting a thickness of the sheet to be fed to the sheet discharge outlet is disposed on the upstream side of the sheet discharge outlet, and the control means controls the height position of the stack tray based on detection information from the thickness detecting means.

20. An image formation system comprising:

an image formation apparatus for sequentially forming images on sheets; and a sheet post-processing apparatus for performing post-processing on the sheets from the image formation apparatus, wherein the sheet post-processing apparatus has a configuration as described in claim 14.

* * * * *